US007431414B2

(12) United States Patent
Takeishi et al.

(10) Patent No.: US 7,431,414 B2
(45) Date of Patent: Oct. 7, 2008

(54) PRINTER-CONTROL APPARATUS, PRINTER-CONTROL METHOD AND PRINTER

(75) Inventors: Tetsuji Takeishi, Nagano-Ken (JP); Hirotomo Tanaka, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 257 days.

(21) Appl. No.: 11/060,592

(22) Filed: Feb. 18, 2005

(65) Prior Publication Data

US 2005/0195226 A1 Sep. 8, 2005

(30) Foreign Application Priority Data

Feb. 20, 2004 (JP) ..... 2004-044676

(51) Int. Cl.
*B41J 29/38* (2006.01)
*B41J 29/393* (2006.01)

(52) U.S. Cl. ..... 347/16; 347/19

(58) Field of Classification Search ..... 347/16, 347/19

See application file for complete search history.

(56) References Cited

U.S. PATENT DOCUMENTS 6,109,745 A * 8/2000 Wen ..... 347/101
6,550,995 B2 4/2003 Hosaka
2002/0018684 A1* 2/2002 Hosaka ..... 400/582
2003/0057635 A1* 3/2003 Fukushima et al. ..... 271/126
2004/0041870 A1* 3/2004 Kohno et al. ..... 347/16

FOREIGN PATENT DOCUMENTS

| | | | |
|---|---|---|---|
| EP | 1 408 607 A1 | | 4/2004 |
| JP | 10-58801 | * | 3/1998 |
| JP | 10-291685 A | | 11/1998 |
| JP | 2001-341368 A | | 12/2001 |
| JP | 2003-79172 A | | 3/2003 |
| JP | 2003-094746 A | | 4/2003 |

* cited by examiner

*Primary Examiner*—Julian D Huffman
(74) *Attorney, Agent, or Firm*—Sughure Mion, PLLC

(57) ABSTRACT

A printer-control apparatus, a printer-control method, and a printer according to the invention sequentially record a relative position of a printing medium specified from an accumulated carried amount of the printing medium and/or driving speed of a paper-feed motor for driving a printing medium carrying mechanism for carrying the printing medium for a period longer than reaction delay time at every time interval shorter than the reaction delay time as a time difference between a time when a front edge or a rear edge of the printing medium reaches an initial position of a swing pin of a mechanical paper detection sensor which detects the front edge and/or the rear edge of the printing medium by swinging operation of the swing pin and a time when the front or rear edge of the printing medium is detected.

14 Claims, 15 Drawing Sheets

| | POSITION | TIME DIFFERENCE |
|---|---|---|
| n | ⋮ | ⋮ |
| n-1 | ⋮ | ⋮ |
| ⋮ | ⋮ | ⋮ |
| ⋮ | ⋮ | ⋮ |
| ⋮ | ⋮ | ⋮ |
| 14 | 78 | 10 |
| 13 | 64 | 10 |
| 12 | 54 | 10 |
| 11 | 44 | 9 |
| 10 | 34 | 8 |
| 9 | 28 | 10 |
| 8 | 22 | 9 |
| 7 | 18 | 8 |
| 6 | 14 | 8 |
| 5 | 11 | 10 |
| 4 | 8 | 8 |
| 3 | 5 | 10 |
| 2 | 3 | 9 |
| 1 | 1 | 10 |

DETECTION POSITION OF PAPER FRONT EDGE → 13

SENSOR POSITION → 5

FIG. 17

PRINTER-CONTROL APPARATUS, PRINTER-CONTROL METHOD AND PRINTER

CROSS REFERENCE TO RELATED APPLICATION

The subject application is related to subject matter disclosed in Japanese Patent Application No. 2004-44676 filed on Feb. 20, 2004 in Japan to which the subject application claims priority under Paris Convention and which is incorporated herein by reference.

BACKGROUND OF THE INVENTION

1. Field of the Invention

The present invention relates to a printer-control apparatus, a printer-control method, and a printer and, more particularly, to a printer-control apparatus and a printer-control method capable of eliminating an error in specifying of the absolute position of a printing medium caused by reaction delay time of a mechanical paper detection sensor for detecting or sensing the front edge and/or the rear edge of the printing medium, and to a printer having such a printer-control apparatus.

2. Background Art

An inkjet printer as a kind of a printer performs printing on the surface of a printing medium by jetting ink from ink nozzles as a number of ink discharging ports formed in a print head while driving a carriage on which the print head is mounted in a main scan direction orthogonal to a printing medium carrying direction over the printing medium and by sequentially carrying the printing medium in a sub scan direction as the printing medium carrying direction.

To realize predetermined high printing quality in such a printing method, the absolute position, carried speed, and carried distance of a printing medium have to be accurately managed and controlled.

Consequently, in a normal inkjet printer, at the time of feeding a printing medium from a tray by a paper-supply roller and supplying it into the printer, the front and rear edges of the printing medium are detected by a paper detection sensor disposed near a paper insertion port and used as basic information for managing and controlling the absolute position and the carried distance of the printing medium.

The relative position of the printing medium specified from an accumulated carried amount of the printing medium by a printing medium carrying mechanism is recorded and managed independently of detection of the front and rear edges of the printing medium by the paper detection sensor. In particular, to adjust a marginal area in the periphery of a printing medium and to match the surface of a printing medium and a printing execution area in the case of performing marginless printing, the front and rear edges of the printing medium have to be detected by the paper detection sensor to detect and manage the absolute position of the printing medium.

Sensors which can be used as the paper detection sensor for detecting the front and rear edges of a printing medium are broadly divided into a mechanical sensor and an optical sensor.

The optical paper detection sensor has advantages such that response at the time of detection is high and reaction delay time is very short. On the contrary, it has disadvantages such that the price is high and a transparent printing medium such as an OHP sheet cannot be detected. Consequently, the ratio of employment as the paper detection sensor is low.

On the other hand, although the mechanical paper detection sensor has disadvantages such that response at the time of detection is lower and reaction delay time is relatively long as compared with the optical paper detection sensor, it has advantages such that the price is low and an arbitrary printing medium including a transparent printing medium can be detected. Consequently, the mechanical paper detection sensor is widely employed as the paper detection sensor.

However, the reaction delay time at the time of detection of the front and rear edges of a printing medium by the mechanical paper detection sensor causes an error in specifying of the absolute position of the printing medium.

In the case where the operation of detecting the front and rear edges of a printing medium is performed in a constant speed period in operation of carrying the printing medium, it is relatively easy to eliminate an error caused by the reaction delay time and accurately specify the absolute position of the printing medium by obtaining the reaction delay time of the mechanical paper detection sensor in advance.

In the case where the operation of detecting the front or rear edge of a printing medium is performed in an acceleration control period or a deceleration control period in the operation of carrying the printing medium, it is difficult to specify the carrying speed of the printing medium at the time point when the front or rear edge of the printing medium actually reaches the position of the mechanical paper detection sensor. It is therefore difficult to accurately specify the absolute position of the printing medium on the basis of detection of the front or rear edge of the printing medium.

An invention for correcting an error in specifying of the absolute position of a printing medium caused by reaction delay time of a mechanical paper detection sensor has been proposed and known. The gist of the invention is to execute approximation calculation by using a speed correction value in a reference table pre-stored in a memory. Refer to, for example, Japanese Patent Laid-Open Publication No. 10-291685.

Hitherto, it was rare that an error in specifying of the absolute position of a printing medium caused by reaction delay time of the mechanical paper detection sensor becomes a big issue. However, as the marginless printing is being spread and the technique development such as increase in printing picture quality progresses, it comes to be requested to specify the absolute position of a printing medium more accurately and to execute a control of carrying a printing medium on the basis of the absolute position at higher precision.

To address such a request, the specifying of the absolute position of a printing medium by approximate calculation is insufficient in precision.

Therefore, it is becoming a more important object to accurately specify the absolute position of a printing medium by eliminating an error caused by reaction delay time of a mechanical paper detection sensor.

Specifically, an error in specifying of the absolute position of a printing medium causes deterioration in precision of the control of carrying the printing medium. As a result, it causes deterioration in the picture quality of a printed image, particularly, deterioration in the picture quality caused by displacement of a printing execution area in a peripheral portion in a printing medium at the time of marginless printing and occurrence of ink mist. Consequently, it is strongly demanded to accurately specify the absolute position of a printing medium by eliminating an error caused by reaction delay time of a mechanical paper detection sensor.

An object of the invention is to provide a printer-control apparatus, a printer-control method, and a printer capable of eliminating an error in specifying of the absolute position of a printing medium caused by reaction delay time of a mechanical paper detection sensor for detecting the front edge and/or the rear edge of the printing medium.

SUMMARY OF THE INVENTION

According to one embodiment of the present invention, there is provided a printer-control apparatus comprising a memory for sequentially recording a relative position of a printing medium specified from an accumulated carried amount of the printing medium and/or driving speed of a paper-feed motor for driving a printing medium carrying mechanism for carrying the printing medium for a period longer than reaction delay time at every time interval shorter than the reaction delay time as a time difference between a time when a front edge or a rear edge of the printing medium reaches an initial position of a swing pin of a mechanical paper detection sensor which detects the front edge and/or the rear edge of the printing medium by swinging operation of the swing pin and a time when the front or rear edge of the printing medium is detected.

In the above construction of the one embodiment of the printer-control apparatus according to the present invention, the printer-control apparatus may comprise a processing unit, when the front edge or the rear edge of the printing medium is detected, for specifying an absolute position of the printing medium by calculating the carried distance of the printing medium since the front or rear edge of the printing medium actually reached the initial position of the swing pin until the front or rear edge of the printing medium was detected on the basis of the record of the relative position of the printing medium and/or the driving speed of the paper-feed motor at each of recording timings in a period going back from the detection time point by a time corresponding to the reaction delay time.

When the reaction delay time in detection of the front edge of the printing medium and that in detection of the rear edge of the printing medium are different from each other, the processing unit may perform an arithmetic operation of specifying the absolute position of the printing medium by using the value of the reaction delay time corresponding to the detected front or rear edge of the printing medium.

When the reaction delay time in detection of the front edge of the printing medium and that in detection of the rear edge of the printing medium are different from each other, the relative position of the printing medium and/or the driving speed of the paper-feed motor may be sequentially recorded in the memory for a period longer than the longer reaction delay time.

New data of the relative position of the printing medium and/or the driving speed of the paper-feed motor may be recorded at a time interval shorter than the reaction delay time in the memory, and the oldest data of the relative position of the printing medium and/or the driving speed of the paper-feed motor may be eliminated from the memory.

According to another embodiment of the present invention, there is provided a printer-control apparatus comprising:

a memory for sequentially recording a relative position of a printing medium specified from an accumulated carried amount of the printing medium and/or driving speed of a paper-feed motor for driving a printing medium carrying mechanism for carrying the printing medium for a period longer than reaction delay time at every time interval shorter than the reaction delay time as a time difference between a time when a front edge or a rear edge of the printing medium reaches an initial position of a swing pin of a mechanical paper detection sensor which detects the front edge and/or the rear edge of the printing medium by swinging operation of the swing pin and a time when the front or rear edge of the printing medium is detected; and a processing unit, when the front edge or the rear edge of the printing medium is detected, for specifying an absolute position of the printing medium by calculating the carried distance of the printing medium since the front or rear edge of the printing medium actually reached the initial position of the swing pin until the front or rear edge of the printing medium was detected on the basis of the record of the relative position of the printing medium and/or the driving speed of the paper-feed motor at each of recording timings in a period going back from the detection time point by a time corresponding to the reaction delay time, and for defining a print execution area in a peripheral portion of the printing medium at the time of marginless printing.

According to one embodiment of the present invention, there is provided a printer-control method sequentially recording a relative position of a printing medium specified from an accumulated carried amount of the printing medium and/or driving speed of a paper-feed motor for driving a printing medium carrying mechanism for carrying the printing medium for a period longer than reaction delay time at every time interval shorter than the reaction delay time as a time difference between a time when a front edge or a rear edge of the printing medium reaches an initial position of a swing pin of a mechanical paper detection sensor which detects the front edge and/or the rear edge of the printing medium by swinging operation of the swing pin and a time when the front or rear edge of the printing medium is detected.

In the above construction of the one embodiment of the printer-control method according to the present invention, when the front edge or the rear edge of the printing medium is detected, the printer-control method may specify an absolute position of the printing medium by calculating the carried distance of the printing medium since the front or rear edge of the printing medium actually reached the initial position of the swing pin until the front or rear edge of the printing medium was detected on the basis of the record of the relative position of the printing medium and/or the driving speed of the paper-feed motor at each of recording timings in a period going back from the detection time point by a time corresponding to the reaction delay time.

According to another embodiment of the present invention, there is provided a printer-control method comprising:

sequentially recording a relative position of a printing medium specified from an accumulated carried amount of the printing medium and/or driving speed of a paper-feed motor for driving a printing medium carrying mechanism for carrying the printing medium for a period longer than reaction delay time at every time interval shorter than the reaction delay time as a time difference between a time when a front edge or a rear edge of the printing medium reaches an initial position of a swing pin of a mechanical paper detection sensor which detects the front edge and/or the rear edge of the printing medium by swinging operation of the swing pin and a time when the front or rear edge of the printing medium is detected;

when the front edge or the rear edge of the printing medium is detected, specifying an absolute position of the printing medium by calculating the carried distance of the printing medium since the front or rear edge of the printing medium actually reached the initial position of the swing pin until the front or rear edge of the printing medium was detected on the basis of the record of the relative position of the printing medium and/or the driving speed of the paper-feed motor at each of recording timings in a period going back from the detection time point by a time corresponding to the reaction delay time; and defining a print execution area in a peripheral portion of the printing medium at the time of marginless printing.

In each construction of the above embodiments of the printer-control method according to the present invention, when the reaction delay time in detection of the front edge of the printing medium and that in detection of the rear edge of the printing medium are different from each other, the relative position of the printing medium and/or the driving speed of the paper-feed motor may be sequentially recorded in the memory for a period longer than the longer reaction delay time.

New data of the relative position of the printing medium and/or the driving speed of the paper-feed motor may be recorded at a time interval shorter than the reaction delay time in the memory, and the oldest data of the relative position of the printing medium and/or the driving speed of the paper-feed motor may be eliminated from the memory.

According to one embodiment of the present invention, there is provided a printer comprising:

a printing medium carrying mechanism which is driven by a paper-feed motor and carries a printing medium;

a print head having a plurality of ink nozzles;

a carriage driving mechanism including a carriage motor for driving a carriage on which the print head is mounted in a main scan direction orthogonal to a printing medium carrying direction over the printing medium;

a mechanical paper detection sensor which detects a front edge and/or a rear edge of the printing medium by swinging operation of a swing pin;

a memory for sequentially recording a relative position of the printing medium specified from an accumulated carried amount of the printing medium and/or driving speed of the paper-feed motor for a period longer than reaction delay time at every time interval shorter than the reaction delay time as a time difference between a time when the front edge or the rear edge of the printing medium reaches an initial position of the swing pin of the mechanical paper detection sensor and a time when the front or rear edge of the printing medium is detected; and a processing unit, when the front edge or the rear edge of the printing medium is detected, for specifying an absolute position of the printing medium by calculating the carried distance of the printing medium since the front or rear edge of the printing medium actually reached the initial position of the swing pin until the front or rear edge of the printing medium was detected on the basis of the record of the relative position of the printing medium and/or the driving speed of the paper-feed motor at each of recording timings in a period going back from the detection time point by a time corresponding to the reaction delay time.

In the above construction of the one embodiment of the printer according to the present invention, the processing unit may define a print execution area in a peripheral portion of the printing medium at the time of marginless printing.

BRIEF DESCRIPTION OF THE DRAWINGS

FIG. 17 is a table showing a structure of a data storage area in a memory for recording relative positions of a printing medium and/or driving speed of the paper-feed motor recorded by the printer-control apparatus, the printer-control method, and the printer according to the embodiment of the invention;

DETAILED DESCRIPTION OF THE INVENTION

An embodiment of printer-control apparatus and printer-control method according to the present invention will be described hereinafter with reference to the drawings.

Disclosed first are an overview of an inkjet printer and a method of controlling the inkjet printer, the main target of the printer-control apparatus and method according to the present invention to be applied.

Figure 1:
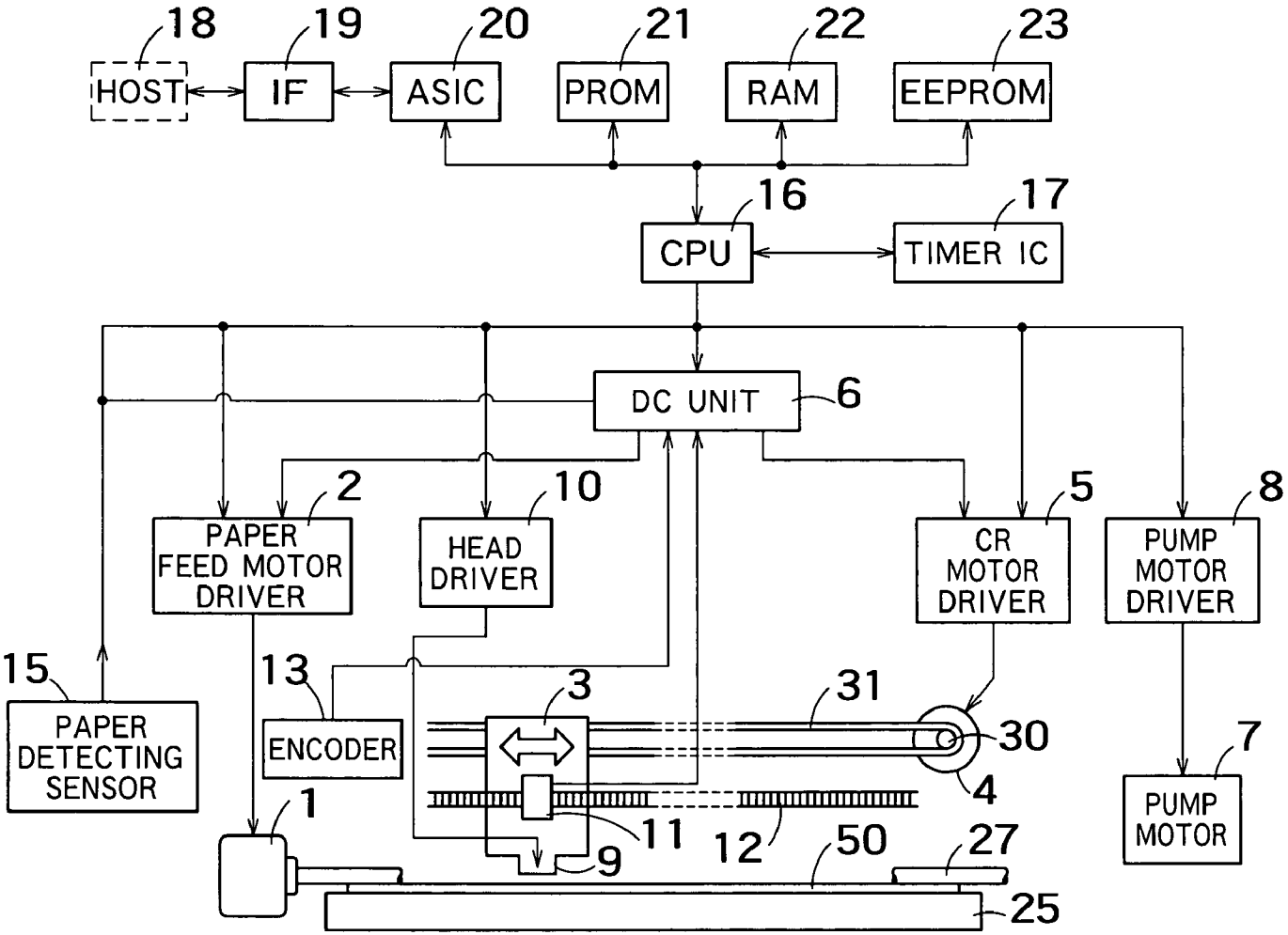
FIG. 1 is a block diagram showing an overview of an inkjet printer.

FIG. 1 is a block diagram showing an overview of an inkjet printer;

The inkjet printer is equipped with the following components: a paper-feed motor (termed as PF motor occasionally) 1 for paper feeding; a paper-feed motor driver 2 for driving the paper-feed motor 1; a carriage 3 having a head 9 for discharging ink onto a printing paper 50, the carriage 3 being driven in directions horizontal to the printing paper 50 and orthogonal to a paper-feed direction; a carriage motor (termed as CR motor occasionally) 4 for driving the carriage 3; a CR-motor driver 5 for driving the carriage motor 4; a DC unit 6 for supplying a motor-drive command value to the CR-motor driver 5; a pump motor 7 for controlling suction of ink to protect the head 9 from being plugged up with dried ink; a pump-motor driver 8 for driving the pump motor 7; a head driver 10 for driving the head 9; a linear encoder 11 fixed on the carriage 3; a code disk 12 having slits formed per a specific interval, incorporated in the linear encoder 11; a rotary encoder 13 to be used for the PF motor 1; a paper detection sensor (paper detecting sensor) 15 for detecting the end of a printing paper under printing process; a CPU 16 for overall control to the printer; a timer IC 17 for periodically generating interrupting signals to the CPU 16; an interface (termed as IF occasionally) 19 for data communications with a host computer 18; an ASIC 20 for controlling printing resolution, driving waveforms, and so on, based on printing information sent from the host computer 18 via the IF 19; a PPROM, a RAM 22 and an EEPROM 23 to be used as working and/or program-storing areas for the ASIC 20 and CPU 16; a platen 25 for supporting the printing paper 50; a transfer roller 27 to be driven by the PF motor 1 for transferring the printing paper 50; a pulley 30 fixed on a rotary shaft of the CR motor 4; and a timing belt 31 to be driven by the pulley 30.

The DC unit 6 drives the paper-feed motor driver 2 and the CR-motor driver 5 based on a control command sent from the CPU 16 and the output of the encoders 11 and 13. The paper-feed motor 1 and the CR motor 4 are a DC motor.

Figure 2:
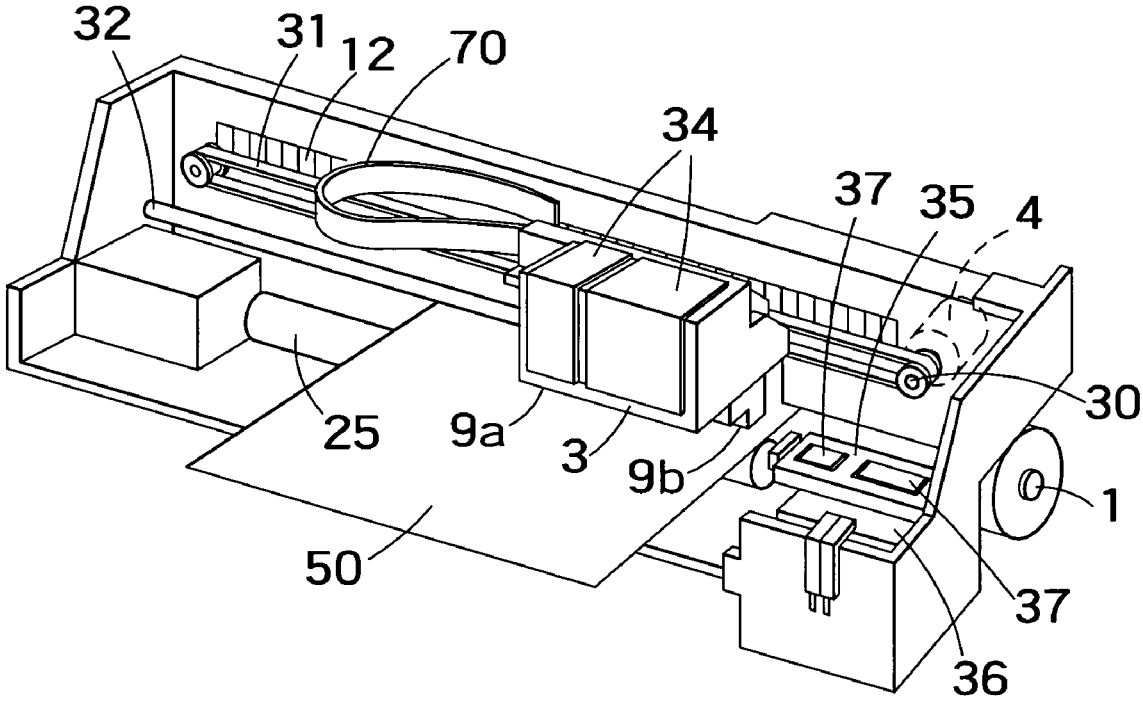
FIG. 2 is a perspective illustration of a carriage 3 and its peripherals in an inkjet printer.

FIG. 2 is a perspective illustration of the carriage 3 and its peripherals of the inkjet printer.

As illustrated in FIG. 2, the carriage 3 is driven as being moved along a guide 32 in the direction parallel to the platen 25 with the timing belt 31 running on the pulley 30 coupled to the carriage motor 4. Provided on the printing-paper facing surface of the carriage 3 is a print head 9 having nozzle alignment for spraying black ink and another nozzle alignment for spraying color ink. Each nozzle splays ink supplied by the ink cartridge 34 onto the printing paper to print characters and/or images thereon.

Incorporated into the inkjet printer within a non-printing area for the carriage 3 are capping unit 35 for capping the nozzles of the print head 9 while no printing process is performed and a pump unit 36 having the pump motor 7 shown in FIG. 1. The carriage 3 touches a lever (not shown) when it has moved from a printing area to the non-printing area. This action leads the capping unit 35 to move up to cap the head 9.

The pump unit 36 sucks ink from the nozzles of the head 9 by means of negative pressure in case of ink plugging occurred to the nozzles or forcefully spraying ink from the head 9 in the replacement of cartridge 34. This ink suction cleans up the nozzles from paper dust and any other dust attached the head 9 close to the nozzle openings and also discharges bubbles generated in the head with ink.

Figure 3:
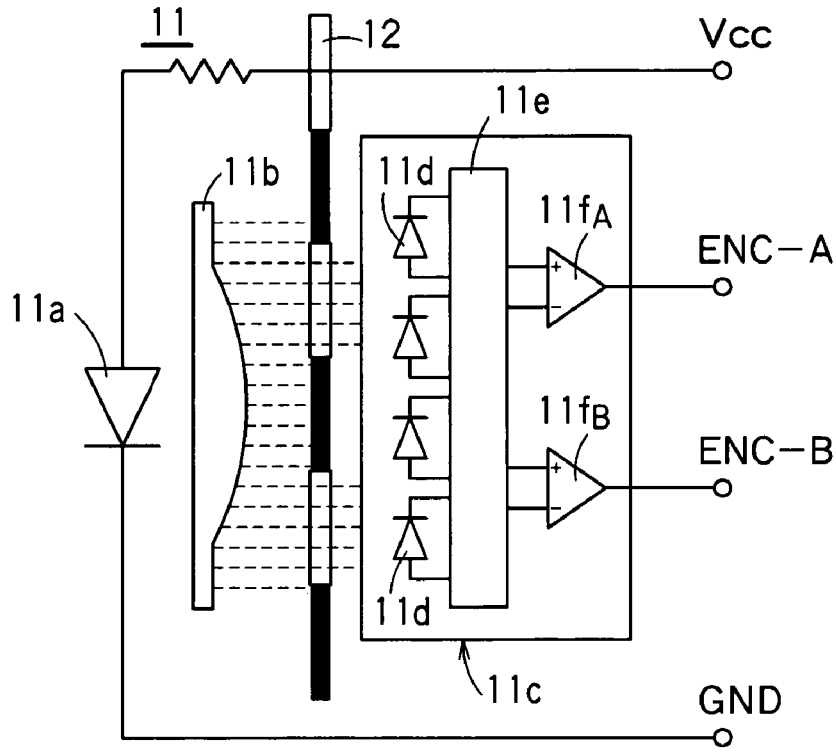
FIG. 3 is a schematic illustration of a linear encoder 11 attached to the carriage 3.

FIG. 3 is a schematic illustration of a linear encoder 11 attached to the carriage 3.

The encoder 11 shown in FIG. 3 is equipped with a light-emitting diode 11*a*, a collimator lens 11*b* and a detection processor 11*c*. The detection processor 11*c* has several (four) photodiodes 11*d*, a signal-processing circuit 11*e* and two comparators $\mathbf{11}f_A$ and $\mathbf{11}f_B$.

The light-emitting diode 11*a* emits light when a voltage Vcc is supplied across the diode 11*a* via resistor. The light is converged into parallel beams by the collimator lens 11*b*, which then pass through the code disk 12. Formed on the code disk 12 are several slits with a specific interval, such as 1/180 inches (1 inch=2.54 cm).

The parallel beams passing through the code disk 12 are incident to the photodiodes 11*d* passing through fixed slits (not shown) and converted into electrical signals. The electrical signals output from the four photodiodes 11*d* are processed by the signal-processing circuit 11*e*. The output signals of the circuit 11*e* are compared with a predetermined value by the comparators $\mathbf{11}f_A$ and $\mathbf{11}f_B$, respectively, thus outputting pulses as comparison results. Output pulses ENC-A and ENC-B of the comparators $\mathbf{11}f_A$ and $\mathbf{11}f_B$ are the outputs of the encoder 11.

Figure 4A:
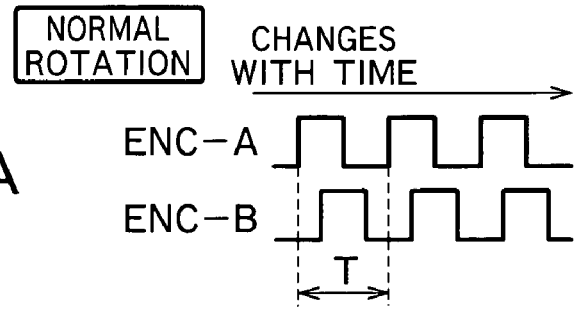
FIGS. 4A and 4B are timing charts indicating two signal waveforms output from the encoder 11 in CR-motor normal rotation and reverse rotation, respectively.
Figure 4B:
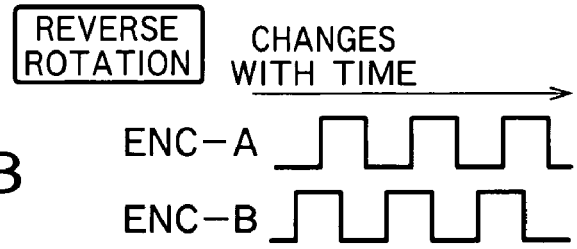

FIGS. 4A and 4B are timing charts indicating two signal waveforms output from the encoder 11 in CR-motor normal rotation and reverse rotation, respectively.

As illustrated in FIGS. 4A and 4B, the pulses ENC-A and ENC-B are shifted from each other by 90 degrees in phase in both CR-motor normal rotation and reverse rotation. In detail, the encoder 4 operates such that, as shown in FIG. 4A, the pulse ENC-A advances from the pulse ENC-B by 90 degrees in phase during the normal rotation of the CR-motor 4 whereas, as shown in FIG. 4B, the pulse ENC-A is delayed from the pulse ENC-B by 90 degrees in phase during the reverse rotation of the CR-motor 4. Each cycle T of the pulses corresponds to the slit interval (1/180 inches, etc) on the code disk 12 and is equal to the time in which the carriage 3 traverses each slit interval.

The rotary encoder 13 used for the PF motor 1 has almost the same structure as the linear encoder 11 except that a code disk of the encoder 13 is a rotary disk rotating with the PF motor 1, to output two pulses ENC-A and ENC-B. Several slits formed on the code disk of the rotary encoder 13 have a slit interval of 1/180 inches. A printing paper is fed by 1/1440 inches while the PF motor 1 rotates by an angle corresponding to each slit interval.

Figure 5:
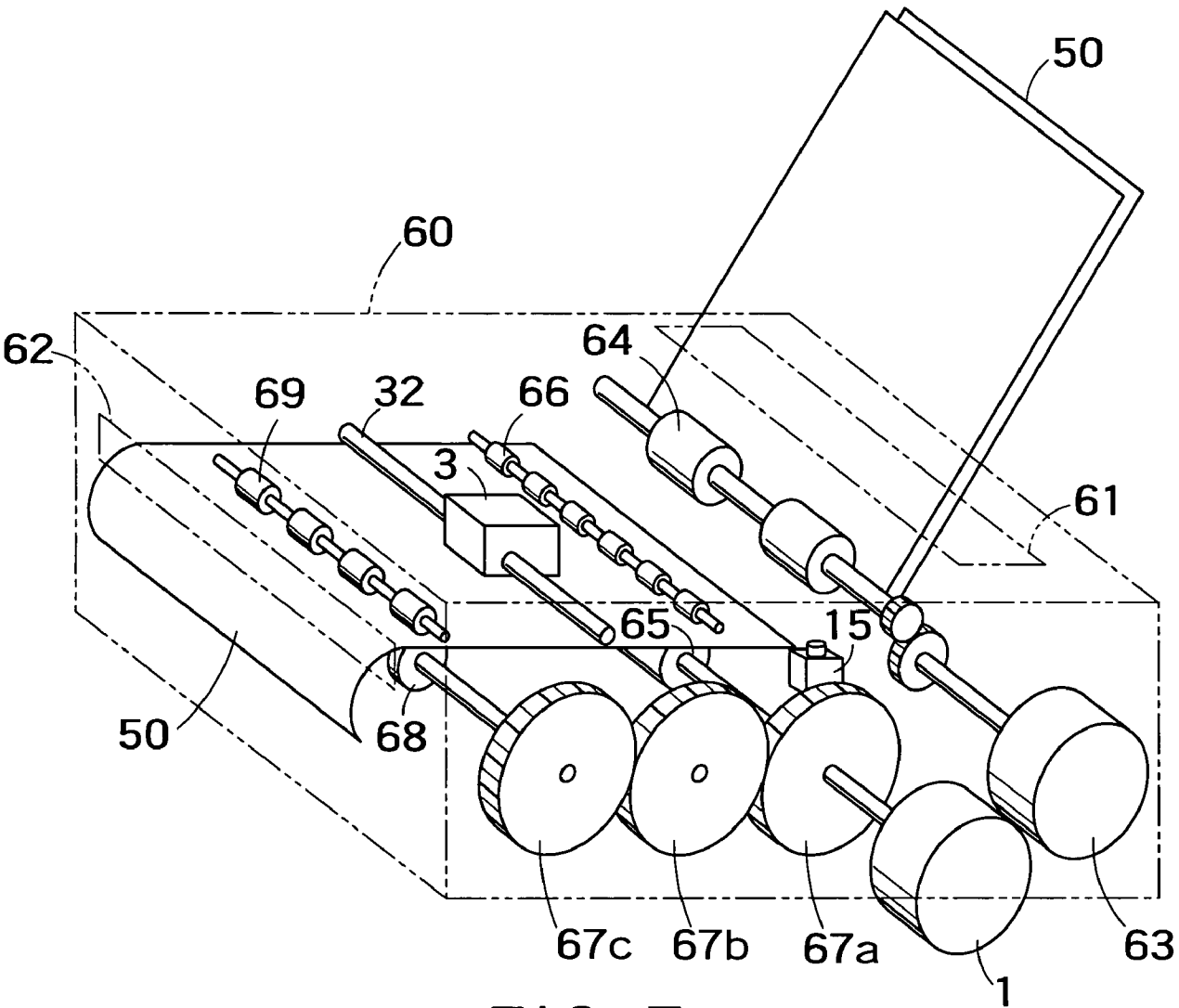
FIG. 5 is a perspective illustration of paper-supplying and detecting mechanisms.

FIG. 5 is a perspective illustration of paper-supplying and detecting mechanisms.

The location of the paper detection sensor 15 shown in FIG. 1 is explained with reference to FIG. 5. Each printing paper 50 inserted into a paper-supply opening 61 is fed into a printer 60 by a paper-supply roller 64 driven by a paper-supply motor 64. The front edge of the printing paper 50 fed into the printer 60 is detected by the paper detection sensor 15 which is a mechanical sensor or an optical sensor. In an embodiment according to the present invention described later, it is supposed that the paper detection sensor 15 is a mechanical sensor. The paper feed advances with a paper-feed roller 65 driven by the PF motor 1 and a driven roller 66 for the printing paper 50 for which the front edge has been detected by the paper detection sensor 15.

A printing process is carried out with ink splayed on the printing paper 50 from the print head (not shown) attached to the carriage 3 moving along the carriage guide 32. When the printing paper 50 has been fed to a specific position, its rear edge is detected by the paper detection sensor 15 during printing. On completion of printing, the printing paper 50 is discharged to the outside through a paper-discharging opening 62 by a paper-discharging roller 68 driven by a gear 67*c* meshed with gears 67*a* and 67*b* driven by the PF motor 1 and also a driven roller 69. The rotary shaft of the paper-feed roller 65 is coupled to the rotary encoder 13.

Figure 6:
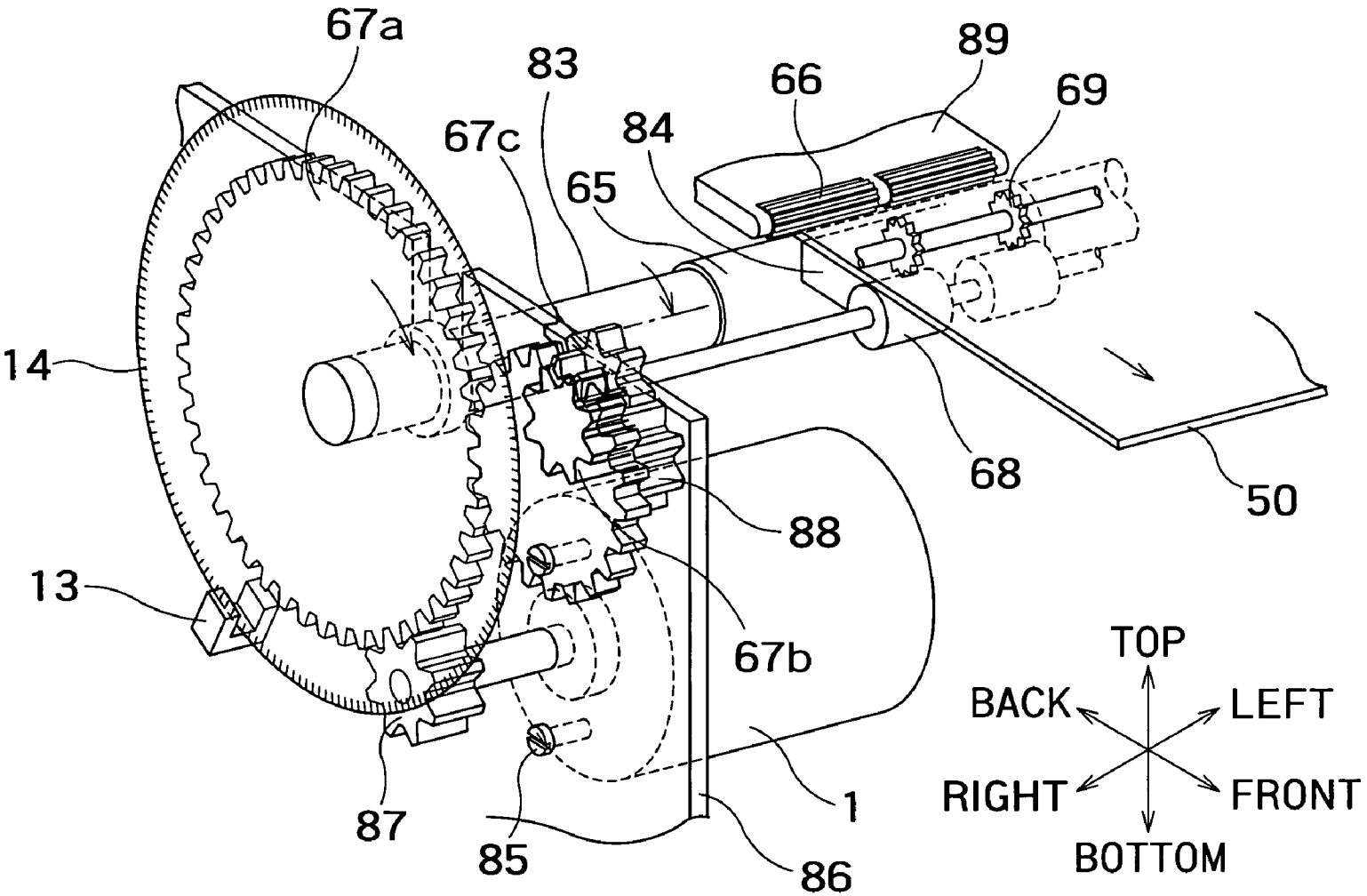
FIG. 6 is a detailed perspective illustration of the paper-feeding mechanism.

FIG. 6 is a detailed perspective illustration of the paper-feeding mechanism.

The paper-feeding mechanism of the printer shown in FIG. 5 is disclosed further in detail with reference to FIGS. 5 and 6.

The paper feed advances with the paper-feed roller 65 and the driven roller 66 on detection of the front edge of the printing paper 50 by the paper detection sensor 15, which has been inserted into the paper-supply opening 61 and fed into the printer 60 by the paper-supply roller 64. The paper-feed roller 65 is attached on a smap shaft 83, the rotary shaft of a large gear 67*a* driven by the PF motor 1 via a small gear 87. The driven roller 66 is attached to a holder 89 at its tip of the paper-discharging side in a paper-feeding direction. The holder 89 presses the printing paper 50 sent from paper-supplying side in the vertical direction.

The PF motor 1 is mounted on a frame 86 with a screw 85 in the printer 60. The rotary encoder 13 is attached to the large gear 67*a* at its specific position. Coupled to the smap shaft 83, the rotary shaft of the large gear 67*a* is a code disk 14 of the rotary encoder.

The printing paper 50 fed by the paper-feed roller 65 and the driven roller 66 passes on a platen 84 that supports the paper 50 and is fed further by the paper-discharging roller 68 driven by the PF motor 1 via the small gear 87, the large gear 67*a*, an intermediate gear 67*b*, a small gear 88 and the paper-discharging gear 67*c*, and also a driven roller 69 having saw-toothed wheels, and then discharged outside through the paper-discharging opening 62.

While the printing paper 50 is supported on the platen 84, the carriage 3 moves left and right along the guide 32 in a space over the platen 84, ink being sprayed from the print head (not shown) for a printing process.

Explained next is the architecture of DC unit 6 which is a DC-motor controller for controlling the CR motor 4 of the inkjet printer described above, and also a printer-control method using the DC unit 6.

Drive control in the case where a DC motor is a CR motor 4 will be described. Incidentally, drive control in the case where the DC motor is the paper-feed motor (PF motor) 1 or a paper-supply motor is substantially the same.

Figure 7:
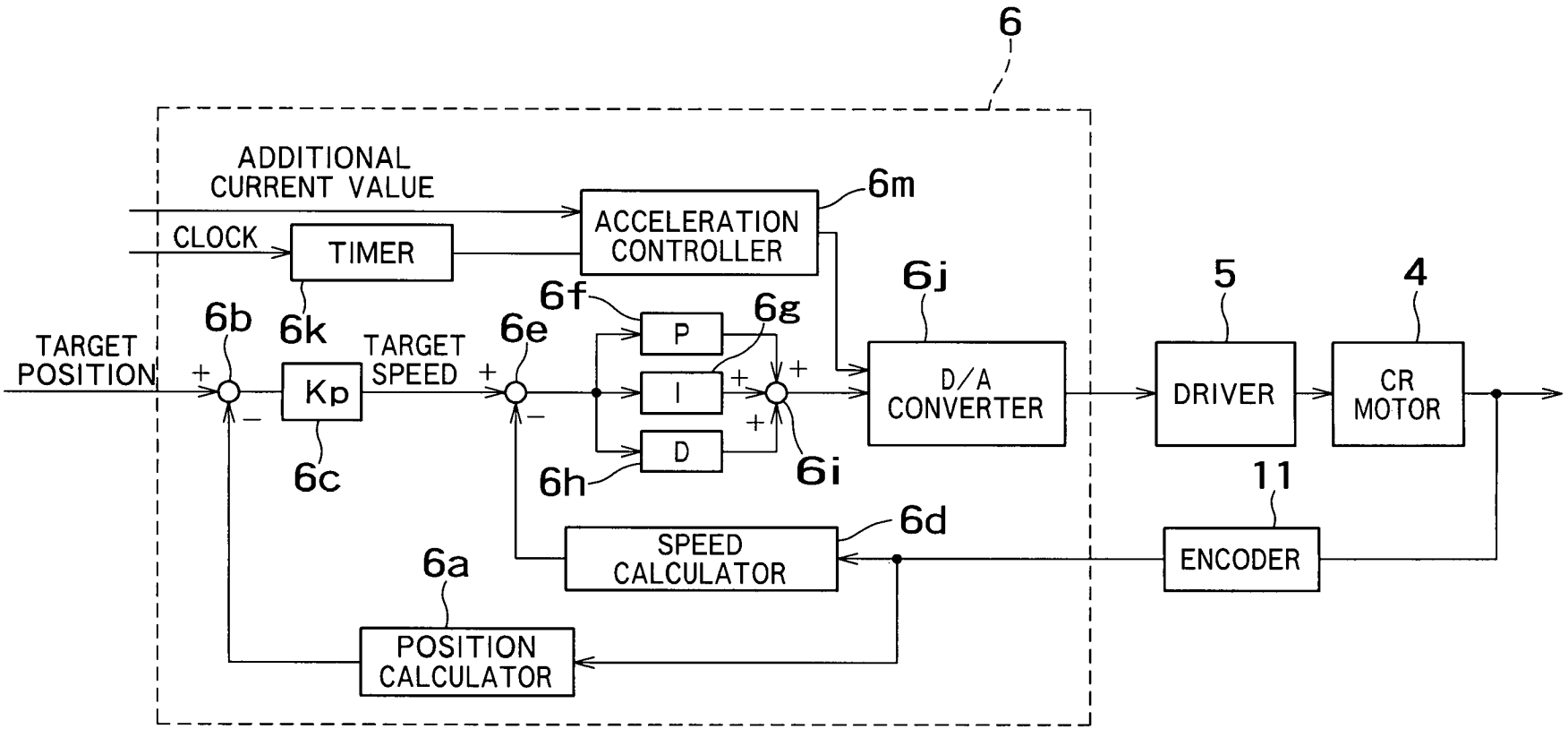
FIG. 7 is a block diagram of a DC unit 6 as a DC-motor controller.
Figures 8A, 8B:
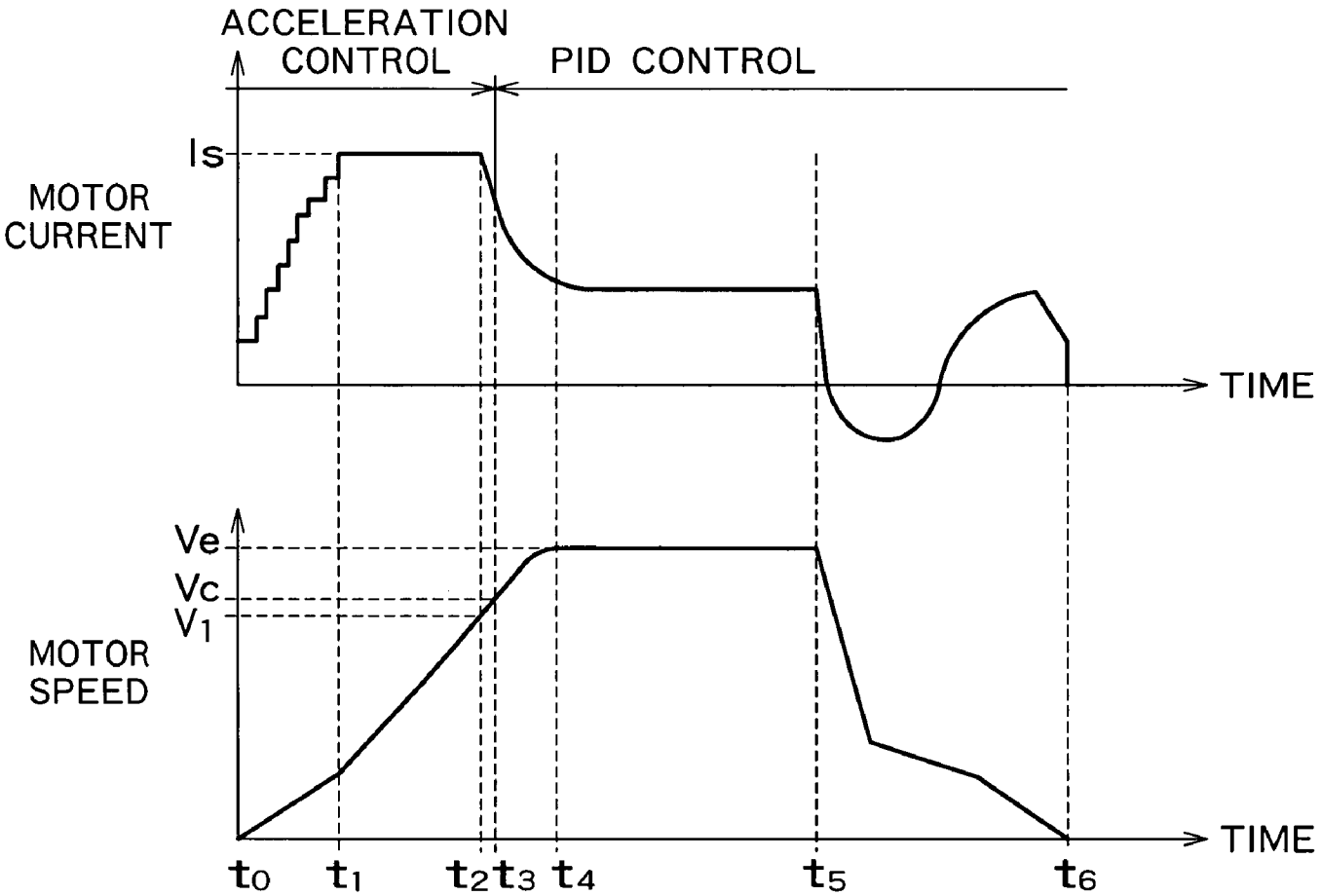
FIGS. 8A and 8B are graphs indicating motor currents and motor speeds for a CR motor 4 controlled by the DC unit 6.

FIG. 7 is a block diagram of the DC unit 6 as a known DC-motor controller. FIGS. 8A and 8B are graphs indicating motor currents and motor speeds for the CR motor 4 controlled by the DC unit 6.

The DC unit 6 shown in FIG. 7 is equipped with a position calculator 6*a*, a subtracter 6*b*, a target-speed calculator 6*c*, a speed calculator 6*d*, a subtracter 6*e*, a proportional component 6*f*, an integral component 6*g*, a differential component 6*h*, an adder 6*i*, a D/A converter 6*j*, a timer 6*k* and an acceleration controller 6*m*.

The position calculator 6*a* detects rising and falling edges of each of the output pulses ENA-A and ENA-B of the encoder 11 and counts the number of detected edges to compute the position of the carriage 3 based on the count value. The counting is performed with addition of [+1] on detection of one edge during the normal rotation of the CR motor 4 whereas addition of [−1] on detection of one edge during the reverse rotation of the CR motor 4. The count value [1] corresponds to ¼ of the slit interval on the code disk 12 because the cycle of both pulses ENA-A and ENA-B is equivalent to the slit interval on the code disk 12 and the pulses ENA-A and ENA-B are shifted from each other by 90 degrees in phase. Thus, multiplication of the count value by ¼ of the slit interval gives the amount of movement for the carriage 3 from the position corresponding to a count value [0]. The resolution for the encoder 11 at the given amount of movement corresponds to ¼ of the slit interval on the code disk 12. The resolution is 1/720 inches to a 1/180-inch slit interval.

The subtracter 6*b* calculates a positional deviation of the actual position of the carriage 3 obtained by the position calculator 6*a* from a target position sent from the CPU 16.

The target-speed calculator 6*c* calculates a target speed for the carriage 3 based on the positional deviation, the output of the subtracter 6*b*. This calculation is performed by multiplying the positional deviation by a gain Kp. The gain Kp is decided in accordance with the positional deviation. Several values for the gain Kp may be stored in a table (not shown).

The speed calculator 6*d* calculates a speed of the carriage 3 based on the output pulses ENA-A and ENA-B of the encoder 11. This speed is obtained as follows: The rising and falling edges of the output pulses ENA-A and ENA-B of the encoder 11 are detected and a time interval between the detected edges corresponding to ¼ of the slit interval on the code disk 12 is counted by the timer counter. The carriage speed is then given by $\lambda/4T$ where $\lambda$ is the slit interval on the code disk 12 and T is the count value. The speed calculation is performed with measurements, by the timer counter, of one cycle of the output pulse ENA-A, for example, from its specific rising edge to the next rising edge.

The subtracter 6*e* calculates a speed deviation of the actual speed of the carriage 3 calculated by the speed calculator 6*d* from a target speed.

The proportional component 6*f* multiplies the speed deviation by a constant Gp and outputs the result of multiplication. The integral component 6*g* integrates speed deviations each multiplied by a constant Gi. The differential component 6*h* multiplies a difference between the current speed deviation and another speed deviation obtained just before the current speed deviation by a constant Gd and outputs the result of multiplication. The computations at the proportional component 6*f*, the integral component 6*g* and the differential component 6*h* are performed for each cycle of the output pulse ENA-A, for example, in synchronism with each rising edge of the output pulse ENA-A.

The outputs of the proportional component 6*f*, the integral component 6*g* and the differential component 6*h* are added by the adder 6*i*. The result of addition, or a drive current for the CR motor 4 is sent to the D/A converter 6*j* and converted into an analog current. The CR motor 4 is then driven by the driver 5 based on the analog current.

The timer 6*k* and the acceleration controller 6*m* are used for acceleration control. The PID control with the proportional component 6*f*, the integral component 6*g* and the differential component 6*h* is performed for constant-speed control during acceleration and deceleration control.

The timer 6*k* generates a timer-interrupting signal per specific period based on a clock signal sent from the CPU 16.

The acceleration controller 6*m* performs integration by adding a specific current value (for example, 20 mA) to a target current value for each receipt of the timer-interrupting signal. The result of integration, or a target current value for the DC motor 4 during acceleration is sent to the D/A converter 6*j*. Like the PID control, the target current value is converted into an analog current by the D/A converter 6*j*. The CR motor 4 is then driven by the driver 5 based on the analog current.

The driver 5 has, for example, four transistors. Each transistor is turned on or off based on the output of the D/A converter 6*j* for several modes: (a) a driving mode for driving the CR motor 4 in normal or reverse rotation, (b) a regenerative braking mode (short braking mode, a mode for keeping the CR motor at a halt), and (c) a mode for bringing the CR motor to a halt.

Described next with reference to FIGS. 8A and 8B is an operation of the DC unit 6, that is, a motor-control method.

The acceleration controller 6*m* supplies a start-up initial current value I0 to the D/A converter 6*j* when a start-up command signal for starting the CR motor 4 is sent from the CPU 16 to the DC unit 6 during the CR motor 4 is keeping at a halt. The start-up initial current value I0 has been sent to the acceleration controller 6*m* from the CPU 16 with the start-up command signal. The start-up initial current value I0 is converted into an analog current by the D/A converter 6*j*. The analog current is then sent to the driver 5 to start the CR motor 4 (as shown in FIGS. 8A and 8B). After receipt of the start-up command signal, the timer 6*k* generates a timer-interrupting signal per specific period. At each receipt of the timer-interrupting signal, the acceleration controller 6*m* performs integration by adding a specific current value (for example, 20 mA) to the start-up initial current value I0. The integrated current value is sent to the D/A converter 6*j*. The integrated current value is then converted into an analog current by the D/A converter 6*j*. The analog current is sent to the driver 5. The driver 5 drives the CR motor 4 to increase the motor speed with the current value supplied to the CR motor 4 equal to the integrated current value (as shown in FIG. 8B). The current value being supplied to the CR motor 4 varies stepwise as shown in FIG. 8A. The D/A converter 6*j* selects and receives the output of the acceleration controller 6*m* while the PID control is also being carried out.

The current-value integration procedure at the acceleration controller 6*m* continues until the integrated current value reaches a constant current value Is. The acceleration controller 6*m* halts the integration procedure when the integrated current value has reached the constant current value Is at the moment t1 and supplies the constant current value Is to the D/A converter 6*j*. The driver 5 thus drives the CR motor 4 with the constant motor-current value Is (as shown in FIG. 8A).

For prevention of the motor speed of the CR motor from overshoot, the acceleration controller 6*m* decreases the current supplied to the CR motor 4 when the motor speed has reached a specific speed V1 (at a moment t2). The speed of the CR motor 4 becomes higher and when it has reached a specific speed Vc (at a moment t3 in FIG. 8B), the D/A converter 6*j* selects the output for PID control, or the output of the adder 6*i* for PID control.

A target speed is calculated based on a positional deviation of the actual position obtained from the output of the encoder 11 from a target position. The proportional component 6*f*, the integral component 6*g* and the differential component 6*h* perform proportional, integral and differential computations, respectively, based on a speed deviation of the actual speed obtained from the output of the encoder 11 from the target speed. The CR motor 4 is then controlled based on the addition of the results of these computations. The proportional, integral and differential computations are performed in synchronism with each rising edge of the output pulse ENC-A of the encoder 11, for example. The DC motor 4 is controlled based on these computations so that the motor speed can be kept at a specific speed Ve. The specific speed Vc is preferably 70 to 80% of the specific speed Ve.

The DC motor 4 is kept at a desired speed from a moment t4 so that the carriage 3 can move at the desired constant speed Ve for a printing process.

When the printing process is completed and the carriage 3 has moved near a target position (at a moment t5 as shown in FIG. 8), the positional deviation and hence the target speed has become small. The speed deviation, or the output of the subtracter 6*e* thus becomes negative, so that the DC motor 4 decelerates to stop at a moment t6.

Drive control in the case where a DC motor is a CR motor 4 has been described above. Drive control in the case where the DC motor is a paper-feed motor (PF motor) 1 or a paper-supply motor is generally the same as in the above-described case.

Although the drive control in the case where the current control is performed as the method of energizing the motor has been described above, PWM control (voltage control) may be alternately employed as the method of energizing the motor.

In this case, the D/A converter 6*j* in FIG. 7 is replaced with a PWM signal generator and the driver 5 on/off controls energization of the motor by a PWM signal. The PWM signal is a signal indicative of the ratio of the ON state and the OFF state in a predetermined period. To be specific, at the time of 100%, the application voltage of the driver is supplied as it is to the motor. At the time of 50%, the voltage which is the half of the application voltage of the driver is equivalently supplied to the motor.

The current value used in the foregoing description of the current value control is expressed by the ON/OFF ratio by the PWM signal in the PWM control.

Figure 9:
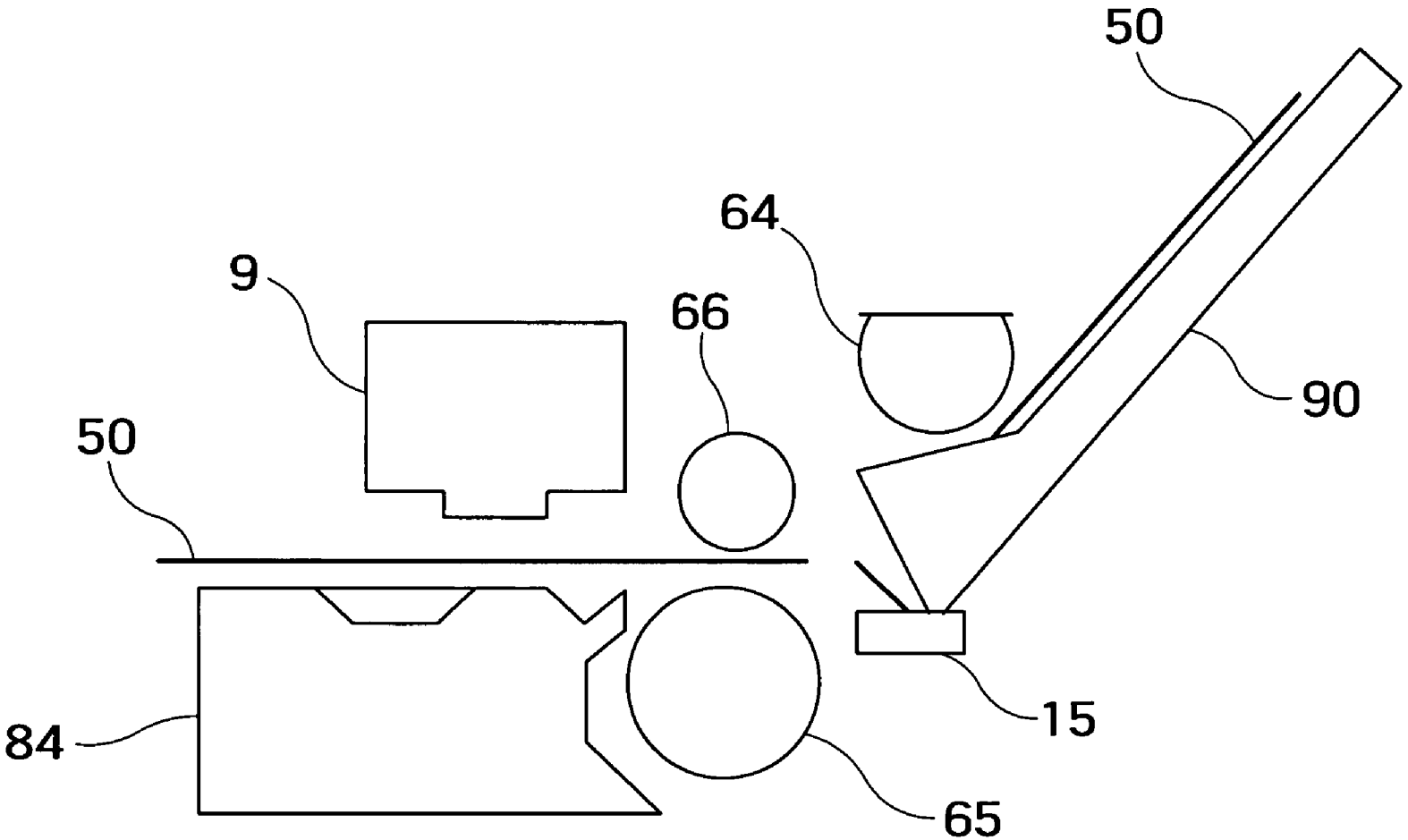
FIG. 9 is a schematic illustration of a configuration for detecting the front and rear edges of a printing medium by a paper detection sensor provided for the inkjet printer.

FIG. 9 is a schematic illustration of a configuration for detecting the front and rear edges of a printing medium by the paper detection sensor provided for the inkjet printer.

The printing paper 50 as a printing medium mounted on a tray 90 is fed by the paper-supply roller 64 and supplied through a paper insertion port into the printer. At this time, the front edge of the printing paper 50 is detected by the paper detection sensor 15 disposed near the paper insertion port in the printer. When the printing paper 50 is sequentially carried by the paper-feed roller 65 and the driven roller 66 in the sub scan direction as the printing medium carrying direction, that is, in the paper ejecting direction, the rear edge of the printing paper 50 is detected when it passes above the paper detection sensor 15.

Printing is carried out by jetting the ink from the print head 9 onto the surface of the printing paper 50 on the platen 84. In order to realize higher picture quality of printing, particularly, to prevent deterioration in the picture quality in the peripheral portion of the printing medium at the time of marginless printing, it is necessary to detect the front and rear edges of the printing medium at high precision and to manage and control the absolute position of the printing medium and the carriage distance at high precision.

Independently of detection of the front and rear edges of the printing medium by the paper detection sensor, the relative position of the printing medium specified on the basis of an accumulated carried amount of the printing medium by a printing medium carrying mechanism is recorded and managed. In particular, to adjust the marginal area in the peripheral portion of the printing medium and to match the surface of the printing medium and a printing execution area in the case of performing marginless printing, it is necessary to detect the front and rear edges of the printing medium by the paper detection sensor and detect and manage the absolute position of the printing medium. If the absolute position of a printing medium cannot be accurately detected and managed, the picture quality of a printed image deteriorates, particularly, the picture quality deteriorates due to displacement of a print execution area in the peripheral portion of the printing medium at the time of marginless printing and occurrence of ink mist caused by the displacement.

As described above, sensors which can be used as the paper detection sensor 15 for detecting the front and rear edges of a printing medium are broadly divided into a mechanical sensor and an optical sensor. The optical paper detection sensor has advantages such that response at the time of detection is high and reaction delay time is very short. On the contrary, it has disadvantages such that the price is high and a transparent printing medium such as an OHP sheet cannot be detected. Consequently, the ratio of employment as the paper detection sensor 15 is low.

On the other hand, although the mechanical paper detection sensor has disadvantages such that response at the time of detection is lower and reaction delay time is relatively long as compared with the optical paper detection sensor, it has advantages such that the price is low and an arbitrary printing medium including a transparent printing medium can be detected. Consequently, the mechanical paper detection sensor is widely employed as the paper detection sensor 15.

However, the reaction delay time at the time of detection of the front and rear edges of a printing medium by the mechanical paper detection sensor causes an error in specifying of the absolute position of the printing medium.

In the case where the operation of detecting the front and rear edges of a printing medium is performed in a constant speed period in operation of carrying the printing medium, it is relatively easy to eliminate an error caused by the reaction delay time and accurately specify the absolute position of the printing medium by obtaining the reaction delay time of the mechanical paper detection sensor in advance.

In the case where the operation of detecting the front or rear edge of a printing medium is performed in an acceleration control period or a deceleration control period in the operation of carrying the printing medium, it is difficult to specify the carrying speed of the printing medium at the time point when the front or rear edge of the printing medium actually reaches the position of the mechanical paper detection sensor. It is therefore difficult to accurately specify the absolute position of the printing medium on the basis of detection of the front or rear edge of the printing medium.

As the marginless printing is being spread and the technique development such as increase in printing picture quality progresses, the request for more accurate specifying of the absolute position of a printing medium and high-precision control of carrying of a printing medium on the basis of the absolute position is increasing. To address such a request, the specifying of the absolute position of a printing medium by approximate calculation is insufficient in precision.

Since the error in specifying of the absolute position of a printing medium causes deterioration in precision of the printing medium carrying control and, as a result, deterioration in the picture quality of a printed image and, particularly, deterioration in the picture quality in a peripheral portion of the printing medium at the time of marginless printing, it is demanded more strongly to accurately specify the absolute position of a printing medium by eliminating an error caused by reaction delay time of a mechanical paper detection sensor.

First, the operation of detecting the front and rear edges of a paper medium by the mechanical paper detection sensor will be described.

FIGS. 10A to 10D are schematic illustrations showing the operation of detecting the front edge of a printing medium by the mechanical paper detection sensor. FIGS. 11A to 11D are schematic illustrations showing the operation of detecting the rear edge of a printing medium by the mechanical paper detection sensor.

As shown in FIGS. 10A to 10D and FIGS. 11A to 11D, the mechanical paper detection sensor 15 has a swing pin 15*a* oriented downward in the vertical direction.

In the operation of detecting the front edge of the printing medium 50 shown in FIGS. 10A to 10D, the front edge of the printing medium 50 carried toward the swing pin 15*a* of the mechanical paper detection sensor 15 comes into contact with the swing pin 15*a* and, at the time point the swing pin 15*a* is swung by predetermined angle θ from the downward orientation, it is detected that the front edge of the printing medium 50 reaches the position of the swing pin 15*a* of the mechanical paper detection sensor 15.

On the other hand, in the operation of detecting the rear edge of the printing medium 50 shown in FIGS. 11A to 11D, the swing pin 15*a* which is swung from the downward orientation to the position by the predetermined angle θ or more by the surface of the printing medium 50 reaches the rear edge of the printing medium by the operation of carrying the printing medium 50 in the paper ejecting direction. After that, the swing pin 50*a* comes off from the rear edge of the printing medium 50, swings, and is oriented downward in the vertical direction. At this time point, it is detected that the rear edge of the printing medium 50 reaches the position of the swing pin 15*a* of the mechanical paper detection sensor 15.

However, it takes predetermined forward swing time ΔtFD for the swing pin 15*a* of the mechanical paper detection sensor 15 to swing by the predetermined angle θ from the downward orientation. Furthermore, it takes predetermined reverse swing time ΔfBK for the swing pin 15*a* to return to the downward orientation from the position of more than the predetermined angle θ. In other words, reaction delay time corresponding to the predetermined forward swing time ΔtFD or the reverse swing time ΔtBK occurs during the period since the front or rear edge of the printing medium 50 actually reaches the position of the swing pin 15*a* of the mechanical paper detection sensor 15 until the mechanical paper detection sensor 15 detects the front or rear edge of the printing medium 50.

The principle of occurrence of the reaction delay time at the time of detection of the mechanical paper detection sensor 15 will be described in detail by referring to FIGS. 10A to 10D and FIGS. 11A to 11D.

Figure 10A:
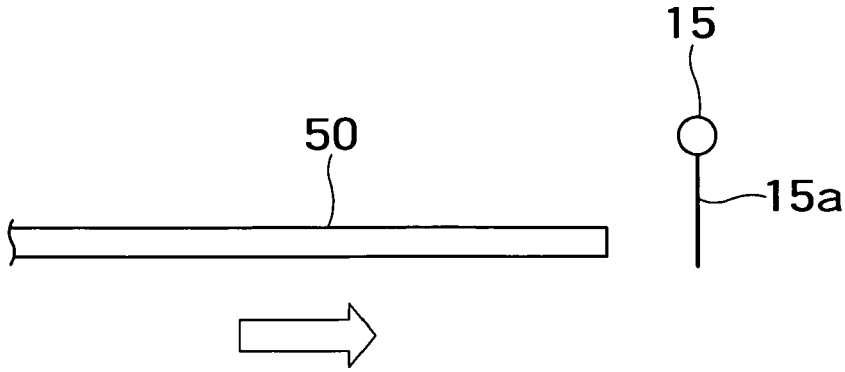
FIGS. 10A to 10D are schematic illustrations showing operation of detecting the front edge of a printing medium by a mechanical paper detection sensor.
Figure 10B:
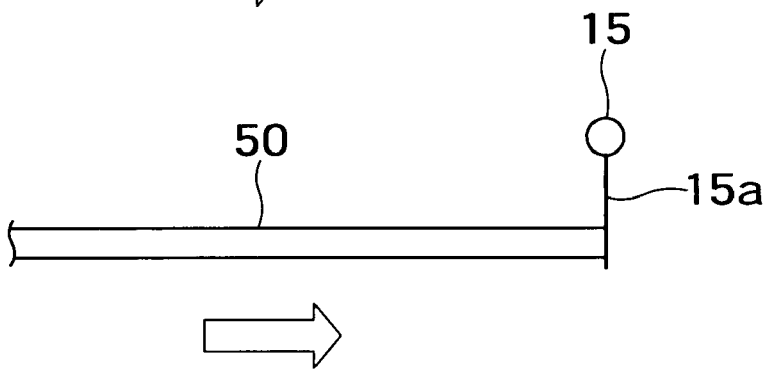

At the time of detection of the front edge of the printing medium 50, as shown in FIG. 10A, when the printing medium 50 is carried in the sub scan direction as the printing medium carrying direction and approaches the swing pin 15*a* of the mechanical paper detection sensor 15, and as shown in FIG. 10B, the front edge of the printing medium 50 comes into contact with the swing pin 15*a* of the mechanical paper detection sensor 15. Although it is inherently ideal that the front edge of the printing medium 50 can be detected at the moment of the contact, since the paper detection sensor 15 has the mechanical mechanism, the reaction delay time occurs as follows.

Figure 10C:
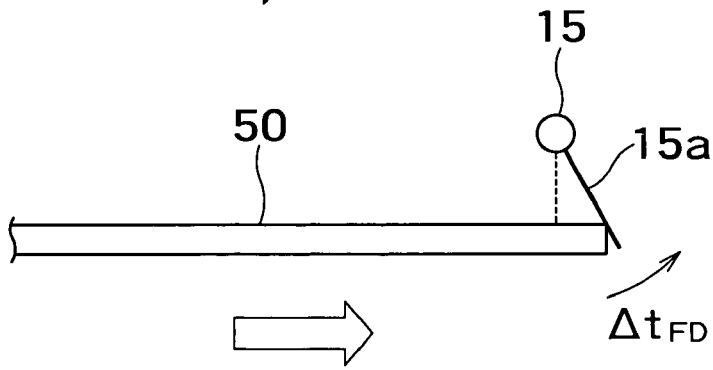
Figure 10D:
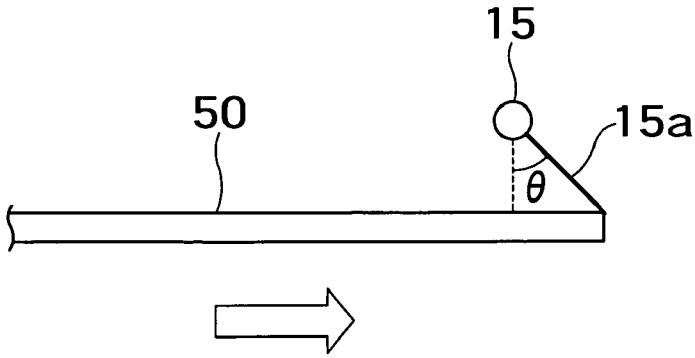

When the front edge of the printing medium 50 comes into contact with the swing pin 15*a* of the mechanical paper detection sensor 15 and, after that, the printing medium 50 is carried in the printing medium carrying direction, as shown in FIG. 10C, the front edge of the printing medium 50 starts pushing up the swing pin 15*a* of the mechanical paper detection sensor 15 so that the swing pin 15*a* swings. When the front edge of the printing medium 50 further makes the swing pin 15*a* swing by the predetermined angle θ from the downward orientation, at the time point, the front edge of the printing medium 50 is detected by the mechanical paper detection sensor 15.

Therefore, in the detection of the front edge of the printing medium 50, the time difference since the time point when the front edge of the printing medium 50 comes into contact with the swing pin 15*a* of the mechanical paper detection sensor 15 to the time point when the swing pin 15*a* is made swing by the predetermined angle θ from the downward orientation, that is, the reaction delay time corresponding to the forward swing time ΔtFD of the swing pin 15*a* occurs.

Figure 11A:
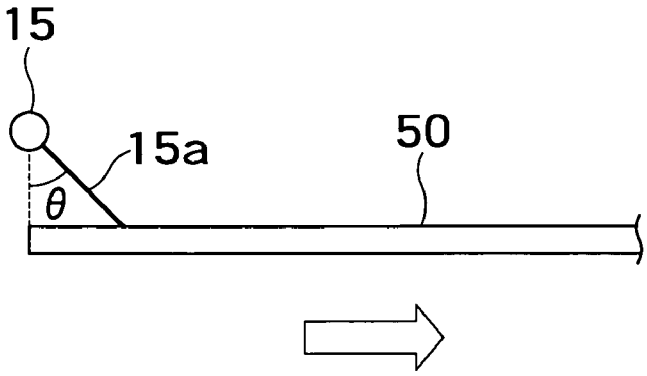
FIGS. 11A to 11D are schematic illustrations showing operation of detecting the rear edge of a printing medium by the mechanical paper detection sensor.

On the other hand, in the detection of the rear edge of the printing medium 50, as shown in FIG. 11A, when the printing medium 50 supporting the swing pin 15*a* of the mechanical paper detection sensor 15 which is swung by the predetermined angle θ or more from the downward orientation is carried in the printing medium carrying direction, the rear edge of the printing medium 50 reaches the initial position of the downward orientation of the swing pin 15*a*. Although it is inherently ideal that the rear edge of the printing medium 50 can be detected at the moment of the contact, since the paper detection sensor 15 has the mechanical mechanism, the reaction delay time occurs as follows.

Figure 11B:
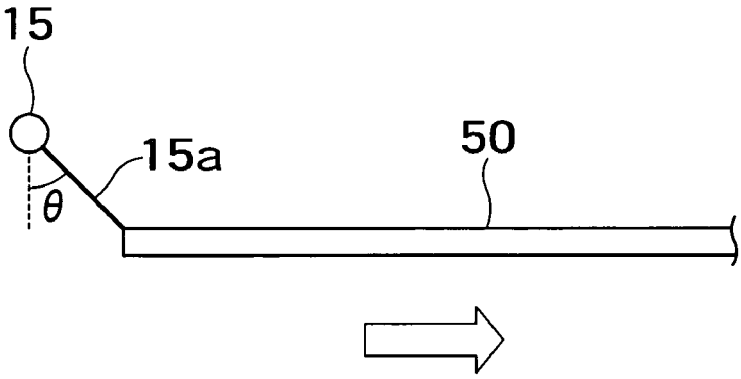

When the rear edge of the printing medium 50 reaches the initial position of the downward orientation of the swing pin 15*a* and, after that, the printing medium 50 is further carried in the printing medium carrying direction, the relative positional relation between the swing pin 15*a* and the printing medium 50 changes and, as shown in FIG. 11B, the tip of the swing pin 15*a* reaches the rear edge of the printing medium 50.

Figure 11C:
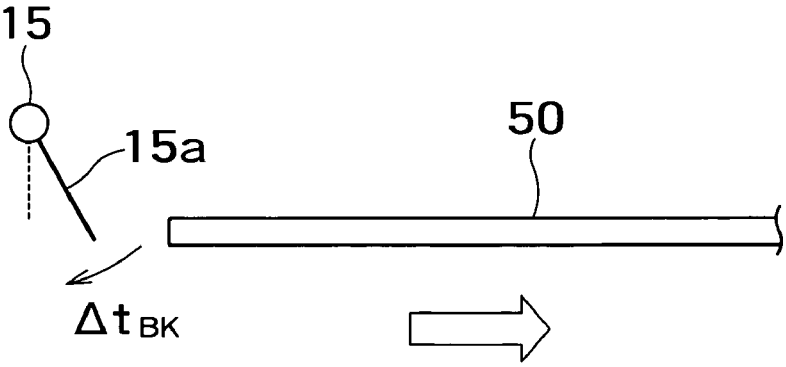
Figure 11D:
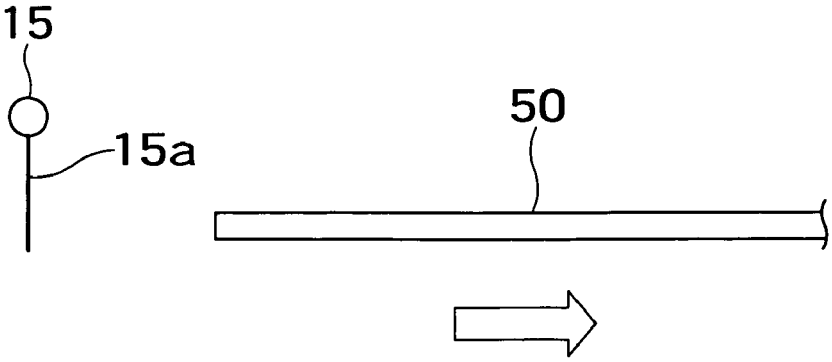

When the printing medium 50 is further carried in the printing medium carrying direction, as shown in FIG. 11C, the tip of the swing pin 15*a* comes off from the rear edge of the printing medium 50 and the swing pin 15*a* starts swinging to the initial position of the downward orientation. At the time point when the swing pin 15*a* swings to the downward orientation as shown in FIG. 11D, it is detected that the rear edge of the printing medium 50 reaches the position of the swing pin 15*a* of the mechanical paper detection sensor 15.

Therefore, in the detection of the rear edge of the printing medium 50, the time difference since the time point when the rear edge of the printing medium 50 reaches the initial position of the downward orientation of the swing pin 15*a* until the time point when the tip of the swing pin 15*a* comes off from the rear edge of the printing medium 50 and swings to the downward orientation, that is, the reaction delay time corresponding to the reverse swing time ΔtBK of the swing pin 15*a* occurs.

As described above, the reaction delay time corresponding to the predetermined forward swing time ΔtFD or the reverse swing time ΔtBK occurs in the detection of the front and rear edges of the printing medium 50. In particular, when the operation of detecting the front or rear edge of the printing medium is performed in the acceleration control period or the deceleration control period in the operation of carrying the printing medium, it is difficult to specify the carrying speed of the printing medium at the time point when the front or reverse edge of the printing medium actually reaches the position of the mechanical paper detection sensor, and it is also difficult to accurately specify the absolute position of the printing medium on the basis of the detection of the front or rear edge of the printing medium.

The principle of occurrence of an error in the specifying of the absolute position of a printing medium in the case where the operation of detecting the front or rear edge of the printing medium is performed in the acceleration control period or the deceleration control period in the operation of carrying the printing medium will now be described.

Figure 12:
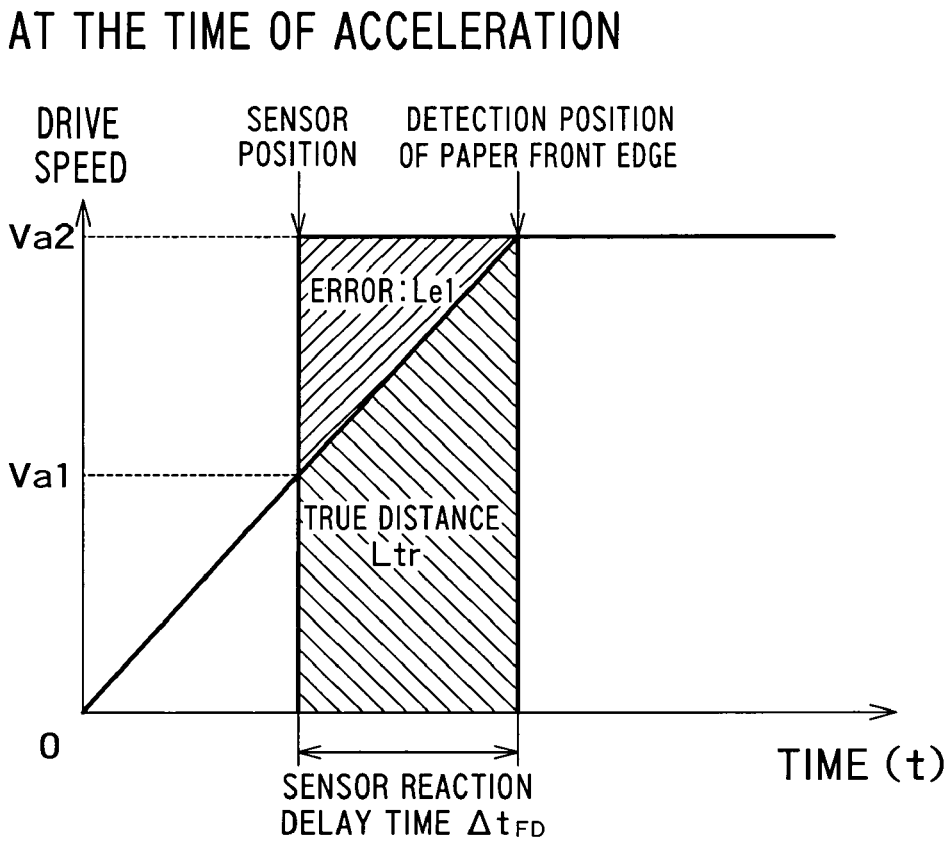
FIG. 12 is a graph showing the principle of occurrence of an error in specifying of the absolute position of a printing medium in the case where the operation of detecting the front edge of the printing medium is performed in an acceleration control period in operation of carrying the printing medium.
Figure 13:
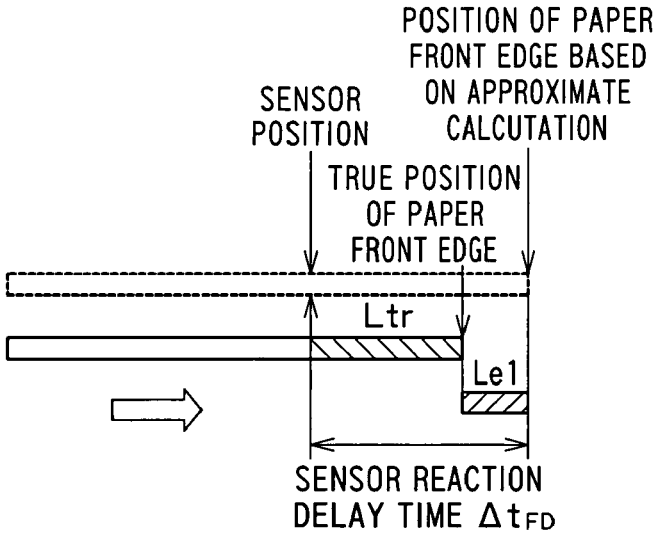
FIG. 13 is a schematic illustration of the principle of occurrence of an error in specifying of the absolute position of a printing medium in the case where the operation of detecting the front edge of the printing medium is performed in the acceleration control period in operation of carrying the printing medium.

FIG. 12 is a graph showing the principle of occurrence of an error in the specifying of the absolute position of a printing medium in the case where the operation of detecting the front edge of the printing medium is performed in the acceleration control period in the operation of carrying the printing medium, and FIG. 13 is a schematic illustration showing the principle of occurrence of an error in the specifying of the absolute position of a printing medium in the case where the operation of detecting the front edge of the printing medium is performed in the acceleration control period in the operation of carrying the printing medium.

As shown in FIG. 12, although the front edge of a printing medium reaches the position of the mechanical paper detection sensor in the acceleration control period of the paper-feed motor for driving the paper-feed roller which conveys a printing medium and the motor speed at the time point is Va1, delay of the reaction delay time ΔtFD occurs until the mechanical paper detection sensor detects the front edge of the printing medium. Consequently, at the time point when the mechanical paper detection sensor detects the front edge of the printing medium, the motor speed becomes Va2.

Therefore, when the motor speed Va2 at the time point the mechanical paper detection sensor detects the front edge of the printing medium is detected from an output pulse of an encoder and the carried distance of the printing medium during the reaction delay time ΔtFD of the mechanical paper detection sensor is calculated by multiplication (Va2×ΔtFD) of the motor speed Va2 and the reaction delay time ΔtFD, the result is equal to "true distance Ltr+an error Le1" which is the value that "the error Le1" is added to "the true distance Ltr", as shown in FIGS. 12 and 13.

Figure 14:
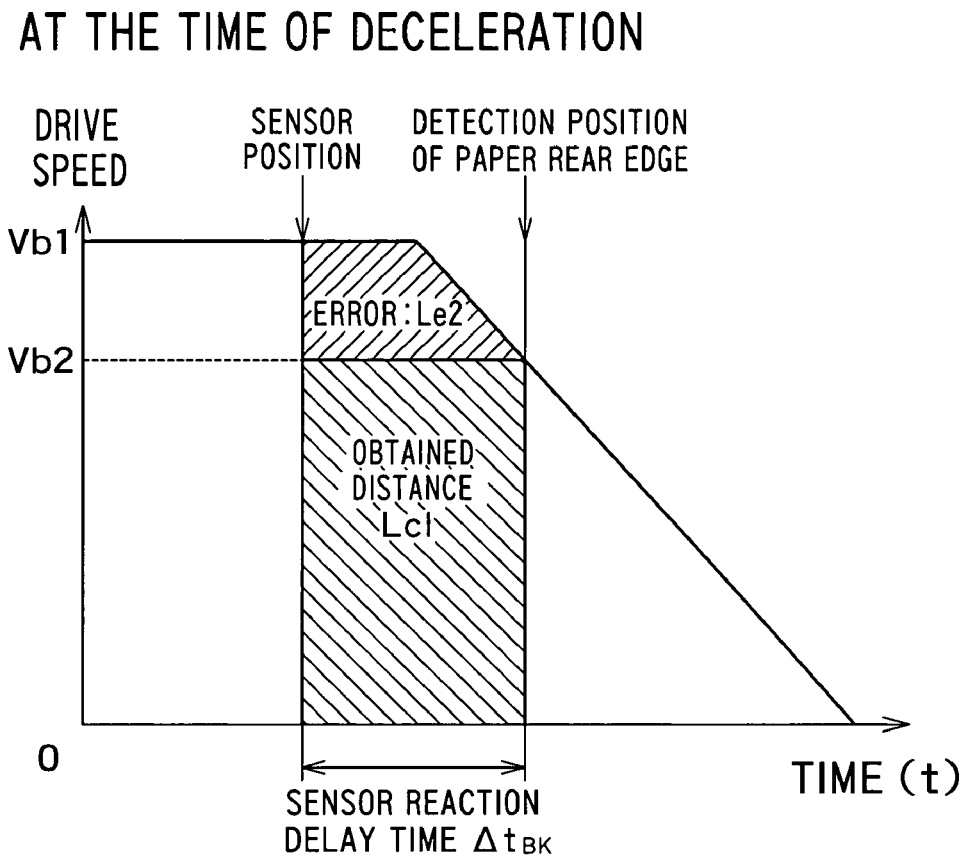
FIG. 14 is a graph showing the principle of occurrence of an error in specifying of the absolute position of a printing medium in the case where the operation of detecting the front edge of the printing medium is performed in a deceleration control period in operation of carrying the printing medium.
Figure 15:
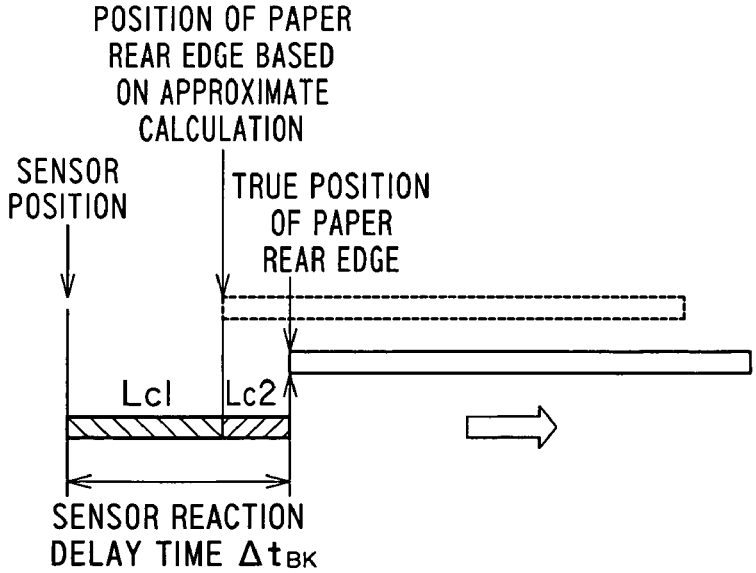
FIG. 15 is a schematic illustration of the principle of occurrence of an error in specifying of the absolute position of a printing medium in the case where the operation of detecting the front edge of the printing medium is performed in the deceleration control period in operation of carrying the printing medium.

FIG. 14 is a graph showing the principle of occurrence of an error in the specifying of the absolute position of a printing medium in the case where the operation of detecting the rear edge of the printing medium is performed in the deceleration control period in the operation of carrying the printing medium, and FIG. 15 is a schematic illustration showing the principle of occurrence of an error in the specifying of the absolute position of a printing medium in the case where the operation of detecting the rear edge of the printing medium is performed in the deceleration control period in the operation of carrying the printing medium.

As shown in FIG. 14, although the rear edge of a printing medium reaches the position of the mechanical paper detection sensor in the deceleration control period of the paper-feed motor for driving the paper-feed roller which conveys a printing medium and the motor speed at the time point is Vb1, delay of the reaction delay time ΔtBK occurs until the mechanical paper detection sensor detects the rear edge of the printing medium. Consequently, at the time point when the mechanical paper detection sensor detects the rear edge of the printing medium, the motor speed becomes Vb2.

Therefore, when the motor speed Vb2 at the time point the mechanical paper detection sensor detects the rear edge of the printing medium is detected from an output pulse of an encoder and the carried distance of the printing medium during the reaction delay time ΔtBK of the mechanical paper detection sensor is calculated by multiplication (Vb2×ΔtBK) of the motor speed Vb2 and the reaction delay time ΔtBK, the result is equal to "a distance Lc1" which is the value that "an error Le2" is subtracted from "a true distance Lc1+Le2", as shown in FIGS. 14 and 15.

In the printer-control apparatus, the printer-control method, and the printer according to the invention, the relative position of a printing medium specified from an accumulated carried amount of the printing medium and/or driving speed of a paper-feed motor is sequentially recorded for a period longer than reaction delay time of a mechanical paper detection sensor at every time interval shorter than the reaction delay time of the mechanical paper detection sensor. When the front edge or rear edge of the printing medium is detected, the carried distance of the printing medium during the period since the front or rear edge of the printing medium reaches the initial position of a swing pin of the mechanical paper detection sensor until the front or rear edge of the printing medium is detected is calculated on the basis of the record of the relative position of the printing medium and/or the driving speed of the paper-feed motor at each recording timing in a period going back by a time corresponding to the reaction delay time of the mechanical paper detection sensor, thereby specifying the absolute position of the printing medium more accurately.

Figure 16:
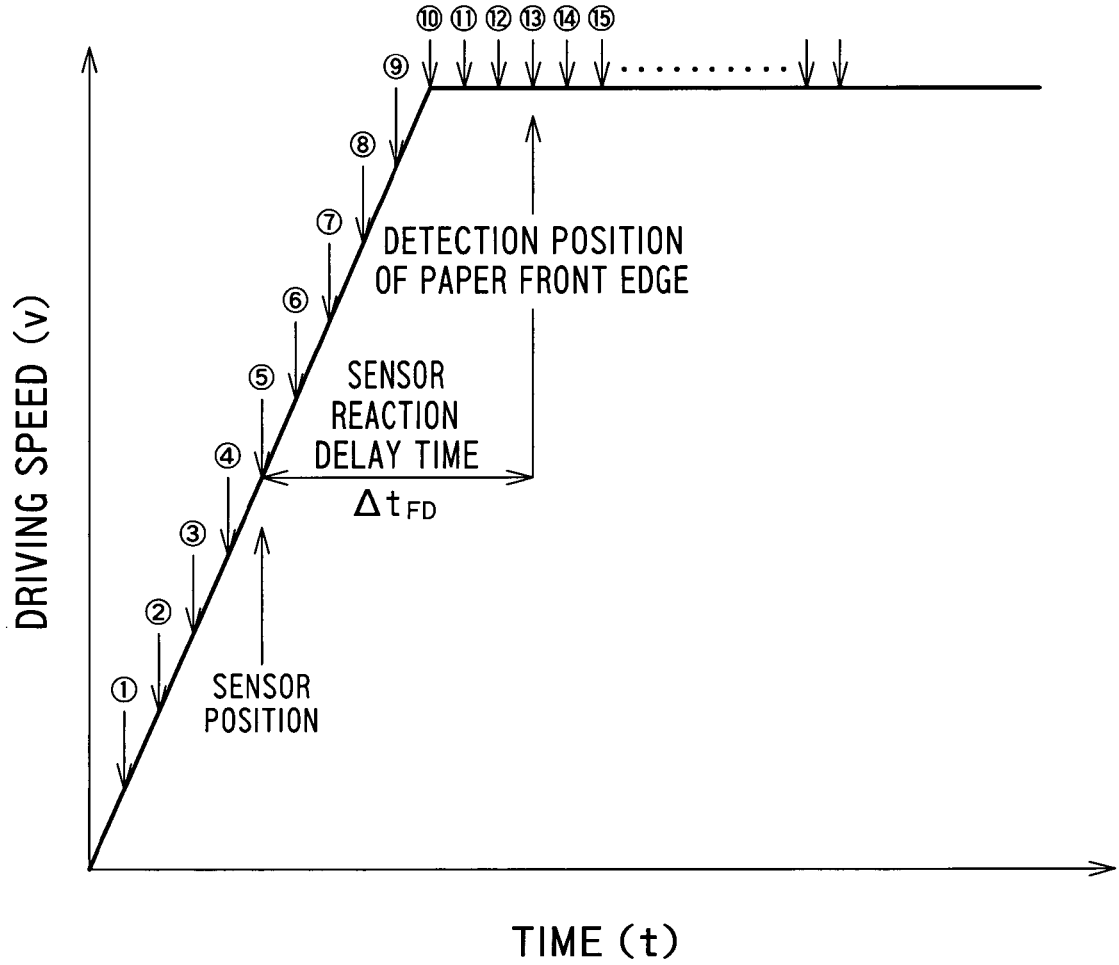
FIG. 16 is a graph showing recording time intervals of relative positions of a printing medium and/or driving speed of a paper-feed motor recorded by a printer-control apparatus, a printer-control method, and a printer according to an embodiment of the invention.

FIG. 16 is a graph showing recording time intervals of relative positions of a printing medium and/or driving speed of a paper-feed motor recorded by a printer-control apparatus, a printer-control method, and a printer according to an embodiment of the invention. FIG. 17 is a table showing a structure of a data storage area in a memory for recording relative positions of a printing medium and/or driving speed of the paper-feed motor recorded by the printer-control apparatus, the printer-control method, and the printer according to the embodiment of the invention.

In the printer-control apparatus, the printer-control method, and the printer according to the invention, as shown in FIGS. 16 and 17, the relative position of a printing medium specified from an accumulated carriage amount of the printing medium and/or driving speed of a paper-feed motor is sequentially recorded for a period longer than reaction delay time of a mechanical paper detection sensor at every time interval shorter than the reaction delay time of the mechanical paper detection sensor.

When the front edge or rear edge of the printing medium is detected, the carried distance of the printing medium during the period since the front or rear edge of the printing medium reaches the initial position of a swing pin of the mechanical paper detection sensor until the front or rear edge of the printing medium is detected is calculated on the basis of the record of the relative position of the printing medium and/or the driving speed of the paper-feed motor at each recording timing in the period going back from the detection time point by the time corresponding to the reaction delay time of the mechanical paper detection sensor, thereby specifying the absolute position of the printing medium more accurately.

In the example of FIG. 17, the relative position of a printing medium specified from the accumulated carried amount of the printing medium is recorded in a data storage area in a memory every time interval shorter than the reaction delay time of the mechanical paper detection sensor.

For example, when it is assumed that the front edge of printing paper as a printing medium is detected at the thirteenth data recording timing, since the reaction delay time of the mechanical paper detection sensor can be measured in advance, it can be specified that the front edge of the printing medium has actually reached the initial position of the swing pin of the mechanical paper detection sensor at the time going back from the time of the thirteenth data recording timing by the reaction delay time ΔtFD of the mechanical paper detection sensor.

Therefore, the fifth data recording timing can be extracted as the data recording timing closest to the time going back from the thirteenth data recording timing by the reaction delay time ΔtFD of the mechanical paper detection sensor. By calculating the difference between the relative position of the printing medium at the thirteenth data recording timing and the relative position of the printing medium at the fifth data recording timing, the carried distance of the printing medium from the initial position of the swing pin of the mechanical paper detection sensor during the time corresponding to the reaction delay time ΔtFD of the mechanical paper detection sensor can be accurately specified.

At each of the data recording timings, the relative position of the printing medium at that time point is sequentially recorded. Consequently, even if acceleration control or deceleration control is performed on the printing medium conveying operation during the period since the front edge of the printing medium actually reaches the initial position of the swing pin of the mechanical paper detection sensor until the front edge of the printing paper is detected, the carried distance of the printing medium during the period can be accurately calculated, and the absolute position of the printing medium can be accurately specified.

After that, high-precision conveying control of the printing medium can be realized on the basis of the specified absolute position of the printing medium.

Also at the time of detecting the rear edge of the printing medium, by specifying the absolute position of the printing medium again, high-precision conveying control of the printing medium can be realized also at or around the rear edge of the printing medium.

As the reaction delay time of the mechanical paper detection sensor, as described above, there are the reaction delay time corresponding to the forward swing time ΔtFD of the mechanical paper detection sensor 15 at the time of detecting the front edge of the printing medium and the reaction delay time corresponding to the reverse swing time ΔtBK of the mechanical paper detection sensor 15 for detecting the rear edge of the printing medium. Although there is a case that they coincide with each other, they often differ from each other.

Therefore, it is preferable to measure both of the forward swing time ΔtFD and the reverse swing time ΔtBK of the mechanical paper detection sensor 15 in advance and properly use the times in accordance with the case of detecting the front edge of a printing medium and the case of detecting the rear edge of a printing medium.

Although the relative position of the printing medium specified from the accumulated carriage amount of the printing medium is recorded in the example of FIG. 17, alternately, the driving speed of the paper-feed motor at each of the data recording timings every predetermined time interval may be recorded.

In the case of recording the driving speed of the paper-feed motor, by calculating the carried distances of the printing medium in each of the periods between the data recording timings during the period since the front edge of a printing medium actually reaches the initial position of the swing pin of the mechanical paper detection sensor until the front edge of the printing paper is detected by multiplication of the driving speed and the time and accumulating the carried distances of the printing medium, the carried distance of the printing medium during the period can be accurately calculated. Thus, the absolute position of the printing medium can be accurately specified.

The time interval of recording the data of the relative position of a printing medium and/or driving speed of the paper-feed motor has to be made shorter than the reaction delay time of the mechanical paper detection sensor. The shorter the time interval of recording data is, the higher the precision of the specifying absolute position of a printing medium is.

Figure 18:
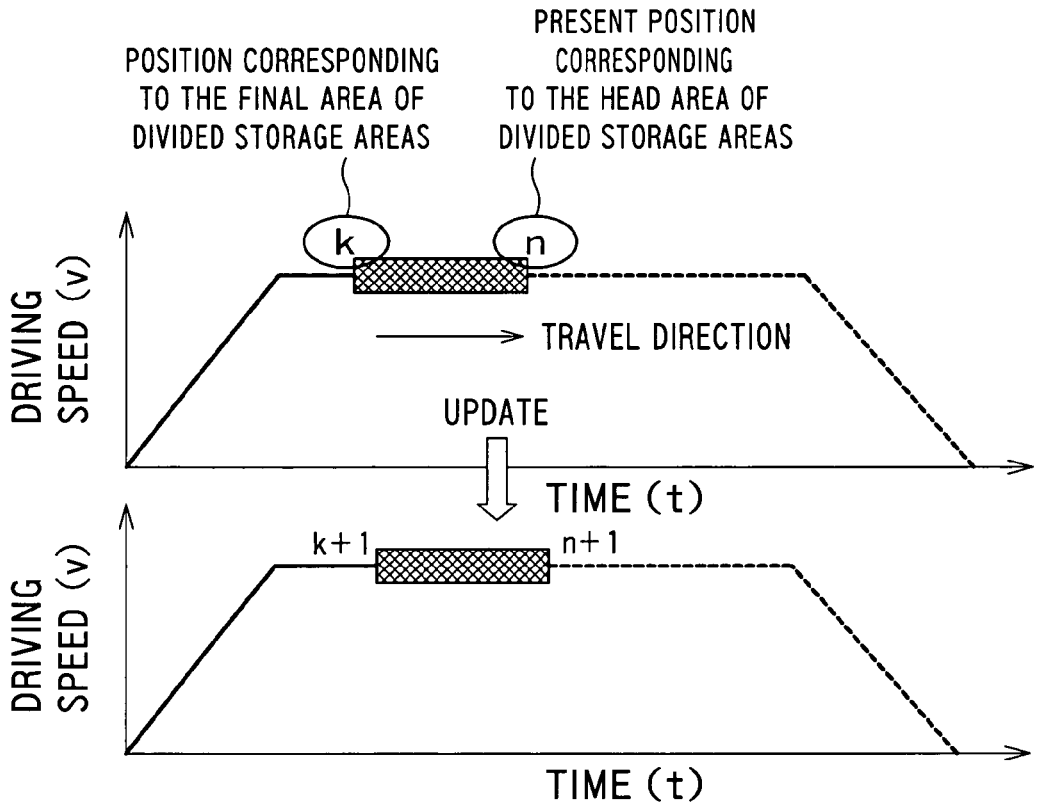
FIG. 18 is a schematic illustration showing a data updating method of relative positions of a printing medium and/or driving speed of the paper-feed motor recorded by the printer-control apparatus, the printer-control method, and the printer according to the embodiment of the invention.
Figure 19:
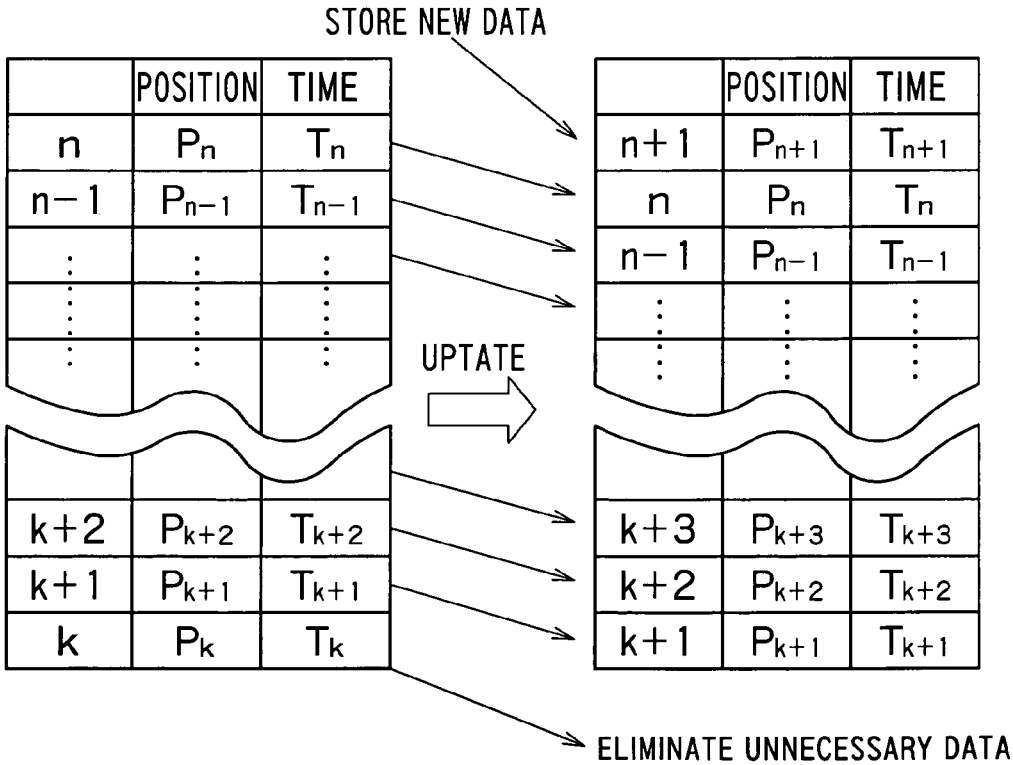
FIG. 19 is a chart showing a data updating method in a data storage area in a memory for recording relative positions of a printing medium and/or driving speed of the paper-feed motor recorded by the printer-control apparatus, the printer-control method, and the printer according to the embodiment of the invention.

FIG. 18 is a schematic illustration showing a data updating method of a relative position of a printing medium and/or driving speed of the paper-feed motor recorded by the printer-control apparatus, the printer-control method, and the printer according to the embodiment of the invention. FIG. 19 is a chart showing a data updating method in a data storage area in a memory for recording a relative position of a printing medium and/or driving speed of the paper-feed motor by the printer-control apparatus, the printer-control method, and the printer according to the embodiment of the invention.

In the example shown in FIGS. 18 and 19, $\{n-(k-1)\}=(n-k+1)$ pieces of data from data of the k-th data recording timing to data of the n-th data recording timing are stored in the data storage area in the memory.

The number of pieces of data to be recorded in the data storage area in the memory may be a number corresponding to time longer than each of the forward swing time ΔtFD and the reverse swing time ΔtBK as the reaction delay time at the time of detecting the front and rear edges of a printing medium by the mechanical paper detection sensor 15.

Therefore, new data is sequentially stored in the head (first) divided storage area of a plurality of divided storage areas constructing the data storage area in the memory. Data stored in the second and subsequent divided storage areas are sequentially shifted toward the final data storage area. Unnecessary data stored in the final data storage area is sequentially eliminated.

As described above, in the printer-control apparatus, the printer-control method, and the printer according to the invention, the relative position of a printing medium specified from an accumulated carried amount of the printing medium and/or driving speed of a paper-feed motor is sequentially recorded for a period longer than reaction delay time of a mechanical paper detection sensor at every time interval shorter than the reaction delay time of the mechanical paper detection sensor. When the front edge or rear edge of the printing medium is detected, the carried distance of the printing medium during the period since the front or rear edge of the printing medium reaches the initial position of a swing pin of the mechanical paper detection sensor until the front or rear edge of the printing medium is detected is calculated on the basis of the record of the relative position of the printing medium and/or the driving speed of the paper-feed motor at each recording timing in a period going back by the time corresponding to the reaction delay time of the mechanical paper detection sensor from the detection time point, thereby specifying the absolute position of the printing medium more accurately.

In the printer-control apparatus and the printer according to the embodiment of the invention, as the controller for receiving the detection signal from the mechanical paper detection sensor 15 and controlling the operation, the CPU 16 in FIG. 1 can be used. As the memory for recording the relative position of a printing medium and/or driving speed of a paper-feed motor, the RAM 22, EEPROM 23, or the like can be used. A program for making the CPU 16 execute the concrete operations may be stored in the PROM 21 or the like.

The mechanical paper detection sensor may detect the front edge and/or the rear edge of a printing medium.

By using the absolute position of a printing medium specified as described above, particularly, for defining the print execution area in a peripheral portion of a printing medium at the time of marginless printing, deterioration in the picture quality caused by displacement of the print execution area from the peripheral portion of the printing medium and occurrence of ink mist due to the displacement can be minimized.

What is claimed is:

1. A printer-control apparatus comprising:

a memory for sequentially recording at least either a relative position of a printing medium specified from an accumulated carried amount of the printing medium or a driving speed of a paper-feed motor for driving a printing medium carrying mechanism for carrying the printing medium;

a mechanical paper detection sensor which detects at least either a front edge or a rear edge of the printing medium by swinging operation of a swing pin; and a processing unit, when the edge of the printing medium is detected by the mechanical paper detection sensor, for specifying an absolute position of the printing medium by calculating the carried distance of the printing medium since the edge of the printing medium to be detected by the mechanical paper detection sensor actually reached an initial position of the swing pin until the edge of the printing medium was detected by the mechanical paper detection sensor on the basis of the records of the relative position of the printing medium or the driving speed of the paper-feed motor at each one of a plurality of recording timings in a period going back from the detection time point by a time corresponding to a reaction delay time, which is a time difference between a time when the edge of the printing medium, that is to be detected by the mechanical paper detection sensor, reaches the initial position of the swing pin, and a time when the edge of the printing medium is detected by the mechanical paper detection sensor;

wherein the recordings in the memory are performed for a period longer than the reaction delay time, each of the recording of the relative position of the printing medium or the driving speed of the paper-feed motor being performed at time intervals shorter than the reaction delay time.

2. The printer-control apparatus according to claim 1, wherein when the reaction delay time in detection of the front edge of the printing medium and that in detection of the rear edge of the printing medium are different from each other in a case that both of the front edge and the rear edge of the printing medium are detected by the mechanical paper detection sensor, the recordings in the memory are performed for a period longer than the longer reaction delay time.

3. The printer-control apparatus according to claim 1, wherein each of new data of the relative position of the printing medium or the driving speed of the paper-feed motor is recorded at a time interval shorter than the reaction delay time in the memory, and the oldest data of the relative position of the printing medium or the driving speed of the paper-feed motor is eliminated from the memory when the new data is recorded.

4. The printer-control apparatus according to claim 1, wherein when the reaction delay time in detection of the front edge of the printing medium and that in detection of the rear edge of the printing medium are different from each other in a case that both of the front edge and the rear edge of the printing medium are detected by the mechanical paper detection sensor, the recordings in the memory are performed for a period longer than the longer reaction delay time.

5. The printer-control apparatus according to claim 1, wherein each of new data of the relative position of the printing medium or the driving speed of the paper-feed motor is recorded at a time interval shorter than the reaction delay time in the memory, and the oldest data of the relative position of the printing medium or the driving speed of the paper-feed motor is eliminated from the memory when the new data is recorded.

6. The printer-control apparatus according to claim 1, wherein when the reaction delay time in detection of the front edge of the printing medium and that in detection of the rear edge of the printing medium are different from each other in a case that both of the front edge and the rear edge of the printing medium are detected by the mechanical paper detection sensor, the processing unit performs an arithmetic operation of specifying the absolute position of the printing medium by using the value of the reaction delay time corresponding to the front edge of the printing medium when the front edge of the printing medium is detected and by using the value of the reaction delay time corresponding to the rear edge of the printing medium when the rear edge of the printing medium is detected.

7. The printer-control apparatus according to claim 6, wherein the recordings in the memory are performed for a period longer than the longer reaction delay time.

8. The printer-control apparatus according to claim 6, wherein each of new data of the relative position of the printing medium or the driving speed of the paper-feed motor is recorded at a time interval shorter than the reaction delay time in the memory, and the oldest data of the relative position of the printing medium or the driving speed of the paper-feed motor is eliminated from the memory when the new data is recorded.

9. A printer-control apparatus comprising:

a memory for sequentially recording at least either a relative position of a printing medium specified from an accumulated carried amount of the printing medium or a driving speed of a paper-feed motor for driving a printing medium carrying mechanism for carrying the printing medium;

a mechanical paper detection sensor which detects at least either a front edge or a rear edge of the printing medium by swinging operation of a swing pin; and a processing unit, when the edge of the printing medium is detected by the mechanical paper detection sensor, for specifying an absolute position of the printing medium by calculating the carried distance of the printing medium since the edge of the printing medium actually reached an initial position of the swing pin until the edge of the printing medium was detected by the mechanical paper detection sensor on the basis of the records of the relative position of the printing medium or the driving speed of the paper-feed motor at each one of a plurality of recording timings in a period going back from the detection time point by a time corresponding to a reaction delay time, which is a time difference between a time when the edge of the printing medium, that is to be detected by the mechanical paper detection sensor, reaches the initial position of the swing pin, and a time when the edge of the printing medium is detected by the mechanical paper detection sensor, and for defining a print execution area in a peripheral portion of the printing medium at a time of marginless printing;

wherein the recordings in the memory are performed for a period longer than the reaction delay time, each of the recording of the relative position of the printing medium or the driving speed of the paper-feed motor being performed at time intervals shorter than the reaction delay time.

10. A printer-control method comprising:

sequentially recording at least either a relative position of a printing medium specified from an accumulated carried amount of the printing medium or a driving speed of a paper-feed motor for driving a printing medium carrying mechanism for carrying the printing medium, at least either a front the edge or a rear edge of the printing medium being detected by swinging operation of a swing pin of a mechanical paper detection sensor, the recordings being performed for a period longer than a reaction delay time, which is a time difference between a time when the edge of the printing medium, that is to be detected by the mechanical paper detection sensor, reaches an initial position of the swing pin, and a time when the edge of the printing medium is detected by the mechanical paper detection sensor, each of the recording of the relative position of the printing medium or the driving speed of the paper-feed motor being performed at time intervals shorter than the reaction delay time; and when the edge of the printing medium is detected by the mechanical paper detection sensor, specifying an absolute position of the printing medium by calculating the carried distance of the printing medium since the edge of the printing medium actually reached the initial position of the swing pin until the edge of the printing medium was detected by the mechanical paper detection sensor on the basis of the records of the relative position of the printing medium or the driving speed of the paper-feed motor at each one of a plurality of recording timings in a period going back from the detection time point by a time corresponding to the reaction delay time.

11. A printer-control method comprising:

sequentially recording at least either a relative position of a printing medium specified from an accumulated carried amount of the printing medium or a driving speed of a paper-feed motor for driving a printing medium carrying mechanism for carrying the printing medium, at least either a front edge or a rear edge of the printing medium being detected by swinging operation of a swing pin of a mechanical paper detection sensor, the recordings being performed for a period longer than a reaction delay time, which is a time difference between a time when the edge of the printing medium, that is to be detected by the mechanical paper detection sensor, reaches an initial position of the swing pin, and a time when the edge of the printing medium is detected by the mechanical paper detection sensor, each of the recording of the relative position of the printing medium or the driving speed of the paper-feed motor being performed at time intervals shorter than the reaction delay time;

when the edge of the printing medium is detected by the mechanical paper detection sensor, specifying an absolute position of the printing medium by calculating the carried distance of the printing medium since the edge of the printing medium actually reached the initial position of the swing pin until the edge of the printing medium was detected by the mechanical paper detection sensor on the basis of the records of the relative position of the printing medium or the driving speed of the paper-feed motor at each one of a plurality of recording timings in a period going back from the detection time point by a time corresponding to the reaction delay time; and defining a print execution area in a peripheral portion of the printing medium at a time of marginless printing.

12. A printer comprising:

a printing medium carrying mechanism which is driven by a paper-feed motor and carries a printing medium;

a print head having a plurality of ink nozzles;

a carriage driving mechanism including a carriage motor for driving a carriage on which the print head is mounted in a main scan direction orthogonal to a printing medium carrying direction over the printing medium;

a mechanical paper detection sensor which detects at least either a front edge or a rear edge of the printing medium by swinging operation of a swing pin;

a memory for sequentially recording at least either a relative position of the printing medium specified from an accumulated carried amount of the printing medium or a driving speed of the paper-feed motor, the recordings being performed for a period longer than a reaction delay time, which is a time difference between a time when the edge of the printing medium, that is to be detected by the mechanical paper detection sensor, reaches an initial position of the swing pin, and a time when the edge of the printing medium is detected by the mechanical paper detection sensor, each of the recording of the relative position of the printing medium or the driving speed of the paper-feed motor being performed at time intervals shorter than the reaction delay time; and a processing unit, when the edge of the printing medium is detected by the mechanical paper detection sensor, for specifying an absolute position of the printing medium by calculating the carried distance of the printing medium since the edge of the printing medium actually reached the initial position of the swing pin until the edge of the printing medium was detected by the mechanical paper detection sensor on the basis of the records of the relative position of the printing medium or the driving speed of the paper-feed motor at each one of a plurality of recording timings in a period going back from the detection time point by a time corresponding to the reaction delay time.

13. The printer according to claim 12, wherein the processing unit defines a print execution area in a peripheral portion of the printing medium at a time of marginless printing.

14. A printer-control method comprising:

detecting at least either a front edge or a rear edge of a printing medium by swinging operation of a swing pin of a mechanical paper detection sensor, and, sequentially recording at least either a relative position of the printing medium specified from an accumulated carried amount of the printing medium or a driving speed of a paper-feed motor for driving a printing medium carrying mechanism for carrying the printing medium, the recordings being performed for a period longer than a reaction delay time, which is a time difference between a time when the edge of the printing medium, that is to be detected by the mechanical paper detection sensor, reaches an initial position of the swing pin, and a time when the edge of the printing medium is detected by the mechanical paper detection sensor, each of the recording of the relative position of the printing medium or the driving speed of the paper-feed motor being performed at time intervals shorter than the reaction delay time;

when the edge of the printing medium is detected by the mechanical paper detection sensor, specifying an absolute position of the printing medium by calculating the carried distance of the printing medium since the edge of the printing medium actually reached the initial position of the swing pin until the edge of the printing medium was detected by the mechanical paper detection sensor on the basis of the records of the relative position of the printing medium or the driving speed of the paper-feed motor at each one of a plurality of recording timings in a period going back from the detection time point by a time corresponding to the reaction delay time; and feeding the printing medium using a paper-feed motor based on the specified absolute position of the printing medium.

* * * * *